US011664003B2

(12) United States Patent
Yan et al.

(10) Patent No.: US 11,664,003 B2
(45) Date of Patent: May 30, 2023

(54) METHOD FOR REDUCING NOISE, STORAGE MEDIUM, CHIP AND ELECTRONIC EQUIPMENT

(71) Applicant: Shenzhen Bluetrum Technology Co., Ltd., Guangdong (CN)

(72) Inventors: Zhangyi Yan, Guangdong (CN); Jinhong Lin, Guangdong (CN); Zhen Wang, Guangdong (CN)

(73) Assignee: Shenzhen Bluetrum Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/893,234

(22) Filed: Aug. 23, 2022

(65) Prior Publication Data

US 2023/0081965 A1 Mar. 16, 2023

(30) Foreign Application Priority Data

Aug. 23, 2021 (CN) ..... 202110969636.7

(51) Int. Cl.
*H04R 25/00* (2006.01)
*G10K 11/178* (2006.01)
*H04R 1/10* (2006.01)

(52) U.S. Cl.
CPC ..... *G10K 11/17854* (2018.01); *H04R 1/1083* (2013.01); *H04R 2460/13* (2013.01)

(58) Field of Classification Search
CPC ..... G10K 11/17854; H04R 1/1083
See application file for complete search history.

(56) References Cited

U.S. PATENT DOCUMENTS

| | | | | |
|---|---|---|---|---|
| 10,219,063 | B1 | 2/2019 | Valenzuela et al. | |
| 2014/0363020 | A1* | 12/2014 | Endo | G10L 21/0208 381/98 |
| 2020/0265857 | A1* | 8/2020 | Zhu | G10L 21/0364 |
| 2021/0297789 | A1* | 9/2021 | De Haan | H04R 25/604 |
| 2021/0329378 | A1* | 10/2021 | Zhang | H04R 1/2803 |

FOREIGN PATENT DOCUMENTS

| | | | |
|---|---|---|---|
| CN | 109767783 | A | 5/2019 |
| CN | 110265056 | A | 9/2019 |
| CN | 110931031 | A | 3/2020 |
| EP | 2811485 | A1 | 12/2014 |

OTHER PUBLICATIONS

Notice of Allowance of counterpart Chinese Patent Application No. 202110969636.7 dated Oct. 12, 2021.

* cited by examiner

*Primary Examiner* — Simon King

(57) ABSTRACT

A method for reducing noise includes: obtaining an air conduction noise reduction parameter and a bone conduction noise reduction parameter, the air conduction noise reduction parameter being obtained by integrating an air conduction parameter of the current frame and an air conduction noise parameter of the current frame, and the bone conduction noise reduction parameter being obtained by integrating a bone conduction parameter of the current frame and a bone conduction noise parameter of the current frame; calculating a priori signal-to-noise ratio of air-bone integration according to the bone conduction parameter of the current frame and the air conduction noise parameter of the current frame; and performing noise reduction operation according to the priori signal-to-noise ratio of air-bone integration, the air conduction noise reduction parameter and the bone conduction noise reduction parameter.

18 Claims, 13 Drawing Sheets

METHOD FOR REDUCING NOISE, STORAGE MEDIUM, CHIP AND ELECTRONIC EQUIPMENT

CROSS-REFERENCE TO RELATED APPLICATIONS

The present disclosure claims priority of Chinese Patent Application No. 202110969636.7, filed on Aug. 23, 2021, titled "method for reducing noise, storage medium, chip and electronic equipment", the contents of which are incorporated herein by reference.

TECHNICAL FIELD

The present disclosure relates to the technical field of noise reduction, and in particular, relates to a method for reducing noise, a storage medium, a chip and an electronic equipment.

BACKGROUND

With the continuous development of mobile voice communication, it is very important to keep the intelligibility, reliability and audibility of voice in noisy environment. It has too many limitations in conventional noise reduction algorithms based on single channel air conduction microphone, e.g., in the case of low signal-to-noise ratio, the voice is easily distorted.

Bone conduction microphones are not affected by environmental noise due to physical sensing characteristics thereof, so the dual-microphone noise reduction method based on bone conduction microphones and air conduction microphones is a preferred choice. The conventional dual-microphone noise reduction method usually uses the bone conduction low-frequency part to directly compensate for the low-frequency part of the air conduction microphone signal. Such a practice results in obvious feeling of switching, which causes hearing discomfort.

SUMMARY

An embodiment of the present disclosure provides a method for reducing noise. The method includes: obtaining an air conduction noise reduction parameter and a bone conduction noise reduction parameter, the air conduction noise reduction parameter being obtained by integrating an air conduction parameter of the current frame and an air conduction noise parameter of the current frame, and the bone conduction noise reduction parameter being obtained by integrating a bone conduction parameter of the current frame and a bone conduction noise parameter of the current frame; calculating a priori signal-to-noise ratio of air-bone integration according to the bone conduction parameter of the current frame and the air conduction noise parameter of the current frame; and performing noise reduction operation according to the priori signal-to-noise ratio of air-bone integration, the air conduction noise reduction parameter and the bone conduction noise reduction parameter.

BRIEF DESCRIPTION OF THE DRAWINGS

One or more embodiments are illustrated by pictures in corresponding attached drawings, and this does not constitute limitation of the embodiments. Elements labeled with the same reference numerals in the attached drawings represent similar elements, and unless otherwise stated, figures in the attached drawings do not constitute scale limitation.

DETAILED DESCRIPTION

In order to make objects, technical solutions and advantages of the present disclosure clearer, the present disclosure will be further described in detail with reference to attached drawings and embodiments. It shall be appreciated that, the specific embodiments described herein are only used to explain the present disclosure, and are not used to limit the present disclosure. Based on the embodiments of the present disclosure, all other embodiments obtained by those of ordinary skill in the art without creative labor belong to the scope claimed in the present disclosure.

It shall be noted that, all features in the embodiments of the present disclosure can be combined with each other if there is no conflict, and all the combination are within the scope claimed in the present disclosure. In addition, although functional modules are divided in the schematic diagrams of the device and logical sequences are shown in the flowchart diagrams, in some cases, the steps shown or described can be performed in module division and sequences different from those in the schematic diagrams and flowchart diagrams. Furthermore, words such as "first", "second" and "third" used in the present disclosure do not limit the data and execution order, but only distinguish same or similar items with basically the same functions and effects.

An embodiment of the present disclosure provides a method for reducing noise. The method may be applied to any suitable type of electronic equipments, such as earphones, mobile phones, smart watches, tablet computers, pagers, loudspeaker boxes or the like. When the electronic equipments are earphones, the earphones may include in-ear headsets, earphones or ear-hanging earphones or the like.

Figure 1:
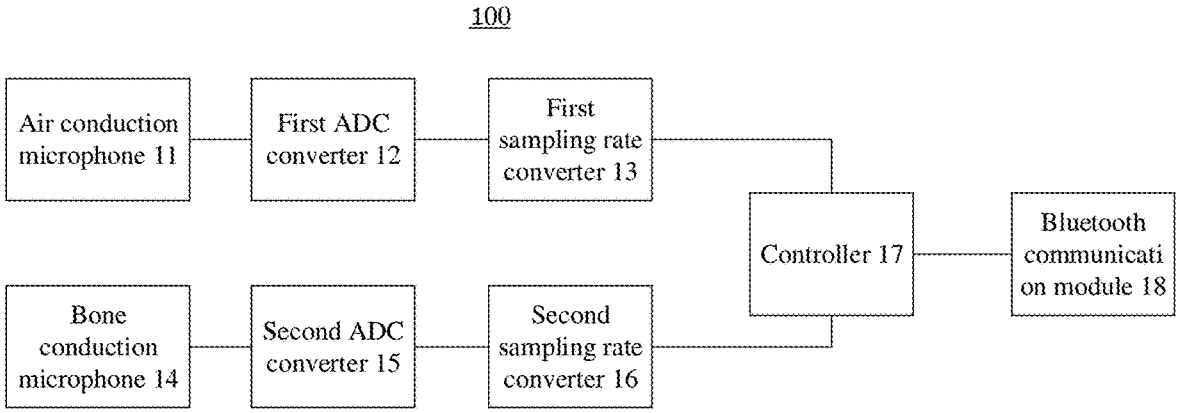
FIG. 1 is a schematic view of a circuit structure of an earphone provided according to an embodiment of the present disclosure.

Referring to FIG. 1, the earphone 100 includes an air conduction microphone 11, a first ADC converter 12, a first sampling rate converter 13, a bone conduction microphone 14, a second ADC converter 15, a second sampling rate converter 16, a controller 17 and a Bluetooth communication module 18.

The air conduction microphone 11 is used for collecting air conduction sound signals, which are sound signals transmitted by air as a transmission medium, wherein the air conduction sound signals may be sound signals with environmental noise or pure sound signals.

The first ADC converter 12 is used for converting the air conduction sound signal into a digital signal, and the first sampling rate converter 13 samples the digital signal according to the sampling rate to obtain an air conduction signal.

The bone conduction microphone 14 is used for collecting bone conduction sound signals, which are sound signals transmitted by a human body part such as bone as a transmission medium, wherein the bone conduction sound signals may be sound signals with electrical noise or pure sound signals.

The second ADC converter 15 is used for converting the bone conduction sound signal into a digital signal, and the second sampling rate converter 16 collects the digital signal according to the sampling rate to obtain a bone conduction signal.

In some embodiments, the sampling rate of the second ADC converter 15 is the same as that of the first ADC converter 12.

The controller 17 performs noise reduction in combination with the noise reduction method described below according to the air conduction signal and the bone conduction signal so as to obtain the noise-reduced voice information.

The Bluetooth communication module 18 performs Bluetooth communication with external equipments under the control of the controller 17, wherein the controller 17 may transmit the noise-reduced voice information to the Bluetooth communication module 18, and the Bluetooth communication module 18 then sends the noise-reduced voice information to the external equipments.

Figure 2:
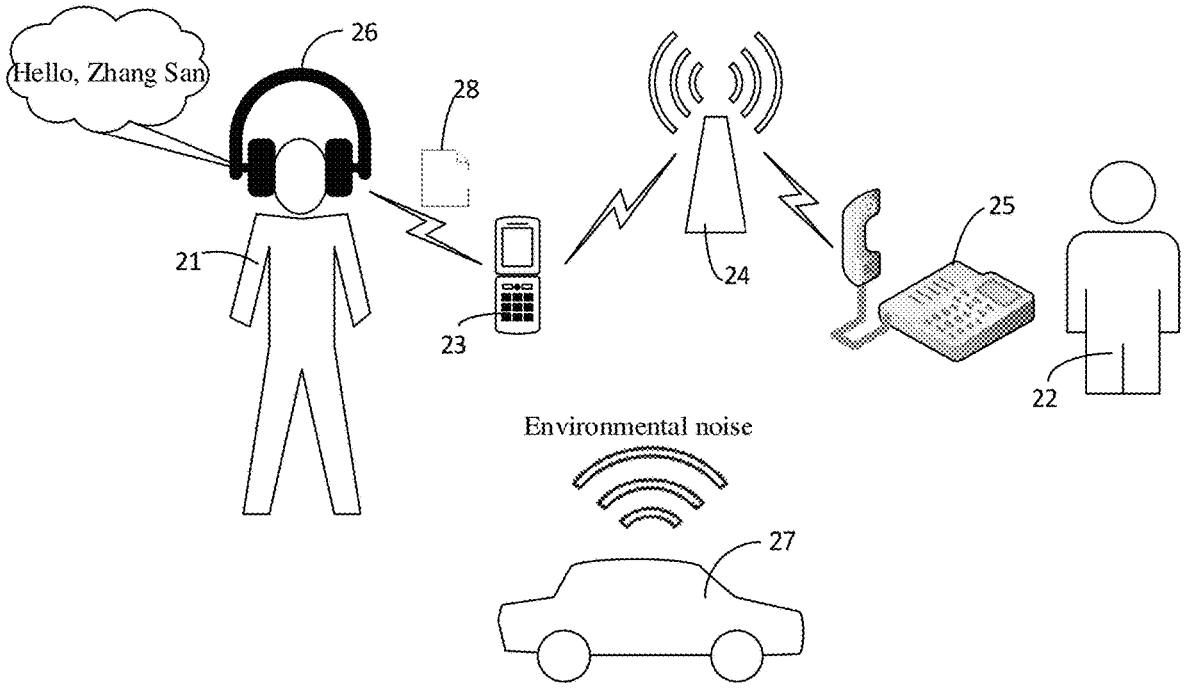
FIG. 2 is a schematic view of a noise reduction scene of an earphone provided according to an embodiment of the present disclosure.

Referring to FIG. 2, a user 21 talks with a user 22 on the phone, wherein a mobile phone 23 of the user 21 establishes a communication connection with a phone 25 of the user 22 through a base station 24.

The user 21 wears an earphone 26, and the earphone 26 establishes Bluetooth communication with the mobile phone 23. The earphone 23 is provided with an air conduction microphone 11 and a bone conduction microphone 14, and the user 21 generates a sound signal "Hello, Zhang San". On the one hand, this sound signal is transmitted to the air conduction microphone 11 through air and collected by the air conduction microphone 11, and at the same time, the air conduction microphone 11 may also collect the environmental noise generated by an automobile 27. On the other hand, this sound signal may also be transmitted to the bone conduction microphone 14 through human body parts such as bone of the user 21 and collected by the bone conduction microphone 14.

The controller 17 performs noise reduction according to the air conduction signal and the bone conduction signal to obtain the noise-reduced voice information 28, and controls the Bluetooth communication module 18 to send the noise-reduced voice information 28 to the mobile phone 23. The mobile phones 23 transmits the noise-reduced voice information 28 to the base station 24, the base station 24 then forwards the noise-reduced voice information 28 to the phone 25, so that the user 22 can hear the noiseless or low-noise voice information on the phone 25.

Before describing the noise reduction method provided according to the embodiment of the present disclosure, a noise reduction method discovered by the inventor in the process of realizing the present disclosure is first described briefly herein. This method first calculates a priori signal-to-noise ratio, then calculates the noise reduction gain based on the priori signal-to-noise ratio, and finally performs noise reduction according to the noise reduction gain. This method calculates the priori signal-to-noise ratio by adopting the Decision-Directed (DD) algorithm, and the conventional DD algorithm is deduced as follows:

$$\widehat{\xi_a}(\ell,k)=a\cdot\widehat{\xi_{a1}}(\ell-1,k)+(1-a)\cdot\widehat{\xi_{a2}}(\ell,k) \quad \text{Equation 1}$$

wherein $\widehat{\xi_a}(\ell, k)$ is the priori signal-to-noise ratio of the kth frequency point in the $\ell$ th frame, $\ell$ is the frame index, k is the frequency point index, $0 \le k \le N$, N is the total number of frequency points, a is the first preset recursive factor which generally ranges from 0.92 to 0.99.

$$\widehat{\xi_{a1}}(\ell-1,k)=|G(\ell-1,k)\cdot Y(\ell-1,k)|^2/\widehat{\sigma_N^2}(\ell-1,k) \quad \text{Equation 2}$$

$$\widehat{\xi_{a2}}(\ell,k)=\max(|Y(\ell,k)|^2/\widehat{\sigma_N^2}(\ell,k)-1,0) \quad \text{Equation 3}$$

$|Y(\ell, k)|^2$ is the power parameter of the air conduction power spectrum corresponding to the kth frequency point in the $\ell$ th frame, $\widehat{\sigma_N^2}(\ell, k)$ is the power parameter of the air conduction noise spectrum corresponding to the kth frequency point in the $\ell$ th frame, $G(\ell, k)$ is the gain corresponding to the kth frequency point in the $\ell$ th frame, $\widehat{\xi_{a1}}(\ell-1, k)$ is the priori signal-to-noise ratio of the kth frequency point in the $(\ell-1)$th frame, and $\widehat{\xi_{a2}}(\ell, k)$ is the maximum value between the value obtained by subtracting the natural number 1 from the posteriori signal-to-noise ratio of the kth frequency point air conduction signal in the $\ell$ th frame and 0.

As can be known from Equation 3, the establishment of the DD algorithm is based on the assumption that human voice and noise are not related to each other. However, in noisy environments or some extreme environments, this assumption is obviously not valid, which will cause distortion of human voice or noise residue. Therefore, the introduction of bone conduction signal can compensate for the distortion of human voice or noise residue or the like caused by low signal-to-noise ratio of air conduction microphone.

Figure 3:
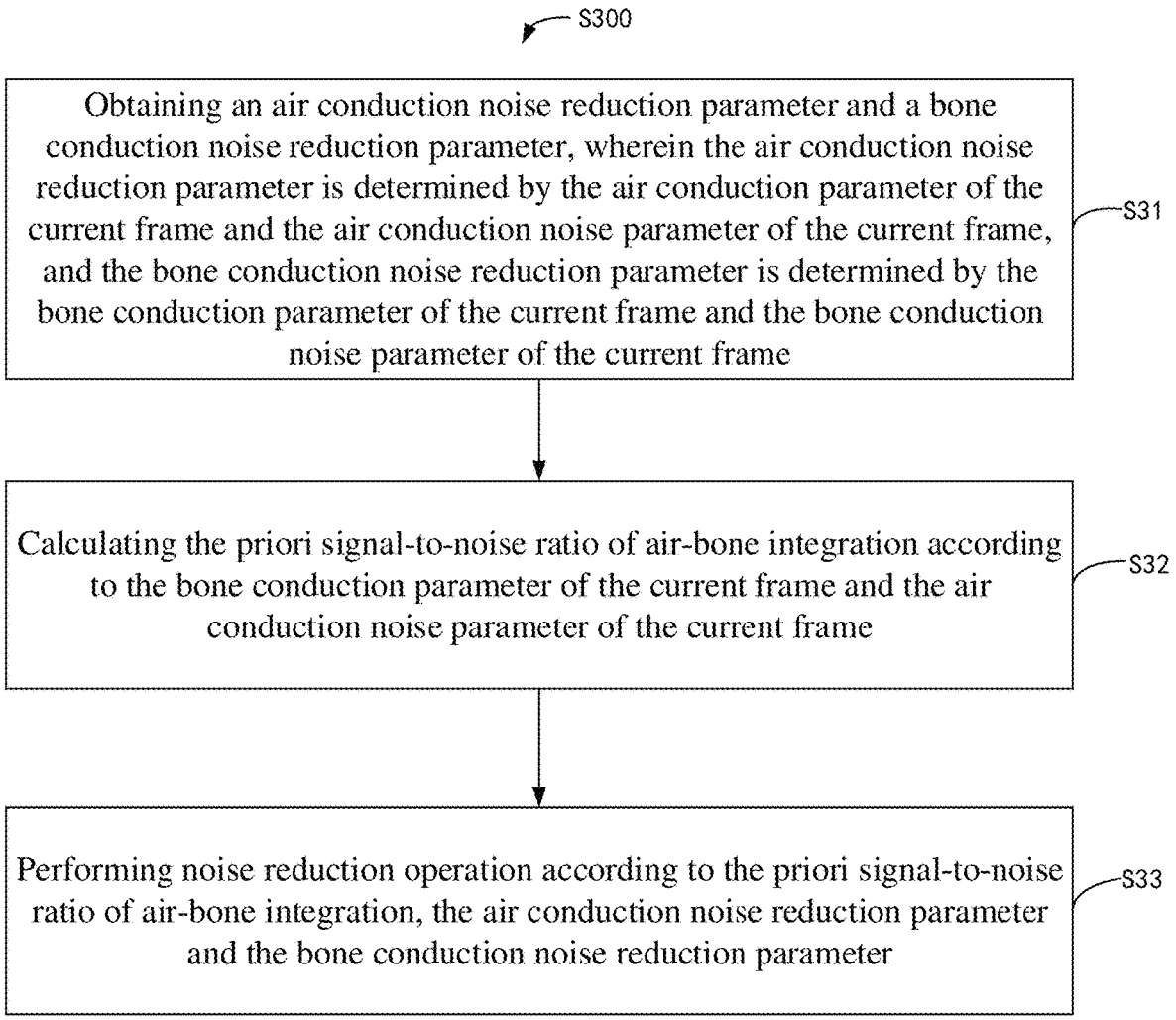
FIG. 3 is a schematic flowchart diagram of a noise reduction method provided according to an embodiment of the present disclosure.

An embodiment of the present disclosure provides a method for reducing noise, referring to FIG. 3, the method for reducing noise S300 includes:

S31: obtaining an air conduction noise reduction parameter and a bone conduction noise reduction parameter, wherein the air conduction noise reduction parameter is obtained by integrating the air conduction parameter of the current frame and the air conduction noise parameter of the current frame, and the bone conduction noise reduction parameter is obtained by integrating the bone conduction parameter of the current frame and the bone conduction noise parameter of the current frame.

In some embodiments, the air conduction parameters of the current frame are the air conduction parameters of the present frame, wherein the air conduction parameters are parameters obtained from the air conduction sound signals collected by the air conduction microphone, and the earphone converts the air conduction sound signals into air conduction parameters according to the Fourier transform algorithm. In some embodiments, the air conduction parameters are air conduction frequency spectrum parameters or air conduction power spectrum parameters, the air conduction frequency spectrum parameters are frequency spectrum parameters of air conduction frequency spectrum, and the air conduction power spectrum parameters are power parameters of air conduction power spectrum.

In some embodiments, the air conduction noise parameters of the current frame are the air conduction noise parameters of the present frame, wherein the air conduction noise parameters are parameters of the air conduction noise spectrum, the air conduction noise spectrum may be extracted from the air conduction frequency spectrum or the air conduction power spectrum according to the noise extraction algorithm. The air conduction noise spectrum comprises the air conduction noise frequency spectrum or the air conduction noise power spectrum, and correspondingly, the air conduction noise parameters comprise the frequency spectrum parameters of the air conduction noise frequency spectrum or the power parameters of the air conduction noise power spectrum.

In some embodiments, the earphone extracts the air conduction parameters of the current frame corresponding to each air conduction frequency point in the effective signal frequency range according to the sampling rate, determines the air conduction noise spectrum according to the air conduction parameters of the current frame, and determines the air conduction noise parameters of the current frame according to the air conduction noise spectrum, wherein the air conduction noise is mainly environmental noise.

In some embodiments, the bone conduction parameters of the current frame are bone conduction parameters of the present frame, wherein the bone conduction parameters are parameters obtained from the bone conduction sound signals collected by the bone conduction microphone, and the earphone converts the bone conduction sound signals into the bone conduction parameters according to the Fourier transform algorithm. In some embodiments, the bone conduction parameter is a bone conduction frequency spectrum parameter or a bone conduction power spectrum parameter, the bone conduction frequency spectrum parameter is a frequency spectrum parameter of the bone conduction frequency spectrum, and the bone conduction power spectrum parameter is a power parameter of the bone conduction power spectrum.

In some embodiments, the bone conduction noise parameters of the current frame are the bone conduction noise parameters of the present frame, wherein the bone conduction noise parameters are parameters of a bone conduction noise spectrum, the bone conduction noise spectrum may be extracted from the bone conduction frequency spectrum or the bone conduction power spectrum according to the noise extraction algorithm. The bone conduction noise spectrum comprises the bone conduction noise frequency spectrum or the bone conduction noise power spectrum, and correspondingly, the bone conduction noise parameters comprise the frequency spectrum parameters of the bone conduction noise frequency spectrum or the power parameters of the bone conduction noise power spectrum.

In some embodiments, the earphone extracts the bone conduction parameter corresponding to each bone conduction frequency point within the effective signal frequency range according to the sampling rate, determines the bone conduction noise spectrum according to the bone conduction parameter of the current frame, and determines the bone conduction noise parameter of the current frame according to the bone conduction noise spectrum, wherein the bone conduction noise is mainly electrical noise.

In some embodiments, the air conduction noise reduction parameter is the parameter of air conduction sound signal after noise reduction operation, and the air conduction noise reduction parameter may be the air conduction noise reduction frequency spectrum or the air conduction noise reduction power spectrum.

Figure 4:
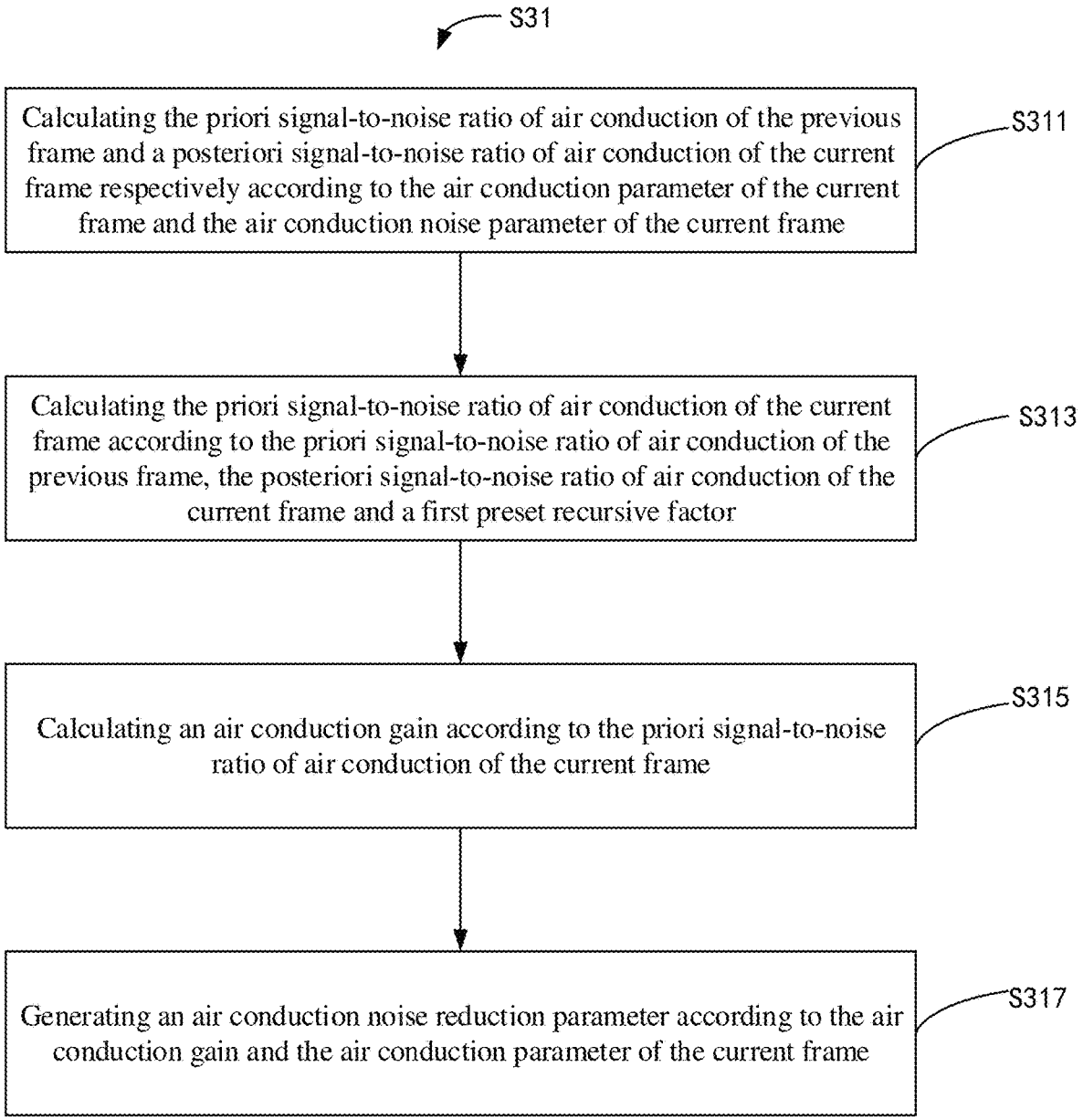
FIG. 4 is a schematic flowchart diagram of acquiring an air conduction noise reduction parameter in S31 shown in FIG. 3.

In some embodiments, referring to FIG. 4, the acquiring the air conduction noise reduction parameter, S31 includes:

S311: calculating the priori signal-to-noise ratio of air conduction of the previous frame and a posteriori signal-to-noise ratio of air conduction of the current frame respectively according to the air conduction parameter of the current frame and the air conduction noise parameter of the current frame;

S313: calculating the priori signal-to-noise ratio of air conduction of the current frame according to the priori signal-to-noise ratio of air conduction of the previous frame, the posteriori signal-to-noise ratio of air conduction of the current frame and a first preset recursive factor;

S315: calculating an air conduction gain according to the priori signal-to-noise ratio of air conduction of the current frame;

S317: generating an air conduction noise reduction parameter according to the air conduction gain and the air conduction parameter of the current frame.

In some embodiments, the priori signal-to-noise ratio of air conduction of the previous frame is the priori signal-to-noise ratio of air conduction signal of which the frame number comes before the air conduction signal of the present frame. For example, the air conduction signal of the lth frame is the air conduction signal of the present frame, the air conduction signal of the (l−1)th frame is the air conduction signal of the previous frame, and the priori signal-to-noise ratio of air conduction signal of the (l−1)th frame is the priori signal-to-noise ratio of air conduction of the previous frame. For another example, referring to Equation 1, $\widehat{\xi_{a1}}(\ell-1, k)$ is the priori signal-to-noise ratio of air conduction of the previous frame, and $\widehat{\xi_{a}}(\ell, k)$ is the priori signal-to-noise ratio of air conduction of the current frame.

In some embodiments, the earphone may acquire the air conduction parameters of the previous frame according to the air conduction parameters of the current frame, and acquire the air conduction noise parameters of the previous frame according to the air conduction noise parameters of the current frame. Then, the earphone calculates the priori signal-to-noise ratio of air conduction of the previous frame according to Equation 2.

In some embodiments, the posteriori signal-to-noise ratio of air conduction of the current frame is the posteriori signal-to-noise ratio of air conduction signal of the present frame. For example, referring to Equation 3, $|Y(\ell, k)|^2/\widehat{\sigma_{N1}^2}(\ell, k)$ is the posteriori signal-to-noise ratio of air conduction signal of the present frame, and $\widehat{\xi_{a2}}(\ell, k)$ is the maximum value between the value obtained by subtracting natural number 1 from the posteriori signal-to-noise ratio of air conduction of the current frame and 0. In some embodiments, the earphone may calculate the posteriori signal-to-noise ratio of air conduction of the current frame according to Equation 3.

Please continue to refer to Equation 1. According to Equation 1, the earphone calculates the priori signal-to-noise ratio of air conduction of the current frame according to the priori signal-to-noise ratio of air conduction of the previous frame, the posteriori signal-to-noise ratio of air conduction of the current frame and the first preset recursive factor.

In some embodiments, the air conduction gain is the gain of reducing the air conduction noise. In some embodiments, the earphone may calculate the air conduction gain according to any suitable gain algorithm, and for example, the gain algorithm comprises the Wiener filtering algorithm or the minimum mean square error algorithm or the like.

In some embodiments, the earphone may obtain the air conduction noise reduction parameter by multiplying the air conduction gain by the air conduction parameter of the current frame. For example, please refer to Equation 4:

$$\widehat{D_s}(\ell,k)=E(\ell,k)\cdot D(\ell,k) \qquad \text{Equation 4}$$

wherein $E(\ell, k)$ is the air conduction gain corresponding to the kth frequency point in the $\ell$ th frame, and $D(\ell, k)$ is the frequency spectrum parameter of the bone conduction frequency spectrum of the kth frequency point in the $\ell$ th frame. That is, $D(\ell, k)$ may be the air conduction parameter of the current frame. $\widehat{D_s}(\ell, k)$ is the air conduction noise reduction parameter of the kth frequency point in the $\ell$ th frame.

In some embodiments, the bone conduction noise reduction parameter is the parameter of a bone conduction sound signal after noise reduction operation, and the bone conduction noise reduction parameter may be the bone conduction noise reduction frequency spectrum or the bone conduction noise reduction power spectrum.

Figure 5:
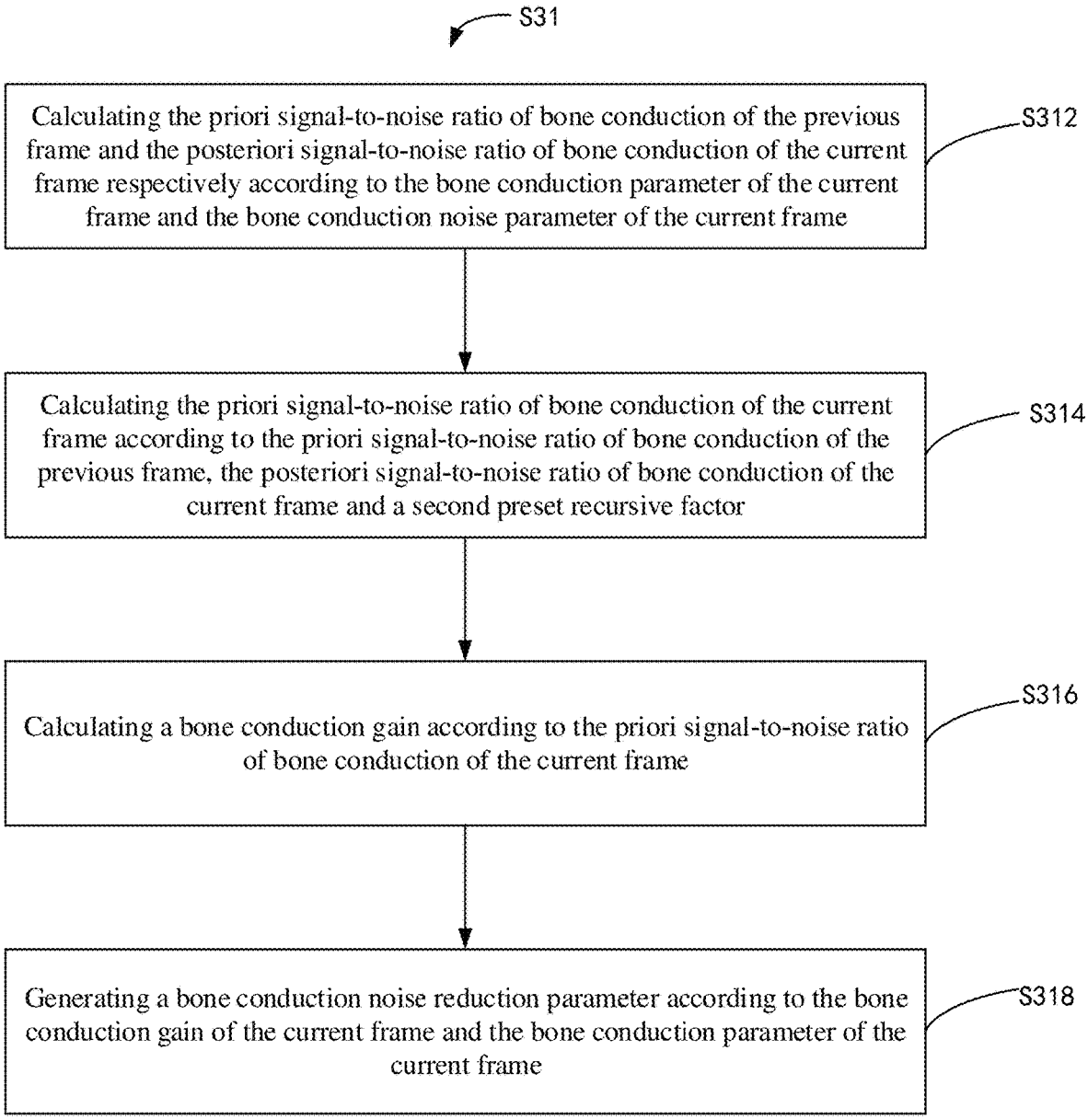
FIG. 5 is a schematic flowchart diagram of acquiring a bone conduction noise reduction parameter in S31 shown in FIG. 3.

In some embodiments, referring to FIG. 5, the obtaining the bone conduction noise reduction parameter, S31 comprises:

S312: calculating the priori signal-to-noise ratio of bone conduction of the previous frame and the posteriori signal-to-noise ratio of bone conduction of the current frame respectively according to the bone conduction parameter of the current frame and the bone conduction noise parameter of the current frame;

S314: calculating the priori signal-to-noise ratio of bone conduction of the current frame according to the priori signal-to-noise ratio of bone conduction of the previous frame, the posteriori signal-to-noise ratio of bone conduction of the current frame and a second preset recursive factor;

S316: calculating a bone conduction gain according to the priori signal-to-noise ratio of bone conduction of the current frame;

S318: generating a bone conduction noise reduction parameter according to the bone conduction gain of the current frame and the bone conduction parameter of the current frame.

In some embodiments, the priori signal-to-noise ratio of bone conduction of the previous frame is the priori signal-to-noise ratio of a bone conduction signal of which the frame number comes before the bone conduction signal of the present frame. For example, the bone conduction signal of the Sth frame is the bone conduction signal of the present frame, the bone conduction signal of the (S−1)th frame is the bone conduction signal of the previous frame, and the priori signal-to-noise ratio of the bone conduction signal of the (S−1)th frame is the priori signal-to-noise ratio of bone conduction of the previous frame.

For example, referring to Equation 5, Equation 6 and Equation 7 together:

$$\widehat{\xi_{c1}}(\ell-1,k)=|G(\ell-1,k)\cdot\mathcal{B}(\ell-1,k)|^2/\widehat{\tau_N^2}(\ell-1,k) \qquad \text{Equation 5}$$

$$\widehat{\xi_{c2}}(\ell,k)=\max(\mathcal{B}(\ell,k)|^2/\widehat{\tau_N^2}(\ell,k)-1,0) \qquad \text{Equation 6}$$

$$\widehat{\xi_c}(\ell,k)=c\cdot\widehat{\xi_{c1}}(\ell-1,k)+(1-c)\cdot\widehat{\xi_{c2}}(\ell,k) \qquad \text{Equation 7}$$

wherein $\widehat{\xi_{c1}}(\ell-1, k)$ is the priori signal-to-noise ratio corresponding to the bone conduction signal of the kth frequency point in the $(\ell-1)$th frame. That is, $\widehat{\xi_{c1}}(\ell-1, k)$ is the priori signal-to-noise ratio of bone conduction of the previous frame, $\widehat{\xi_{c2}}(\ell, k)$ is the maximum value between the value obtained by subtracting the natural number 1 from the posteriori signal-to-noise ratio of the bone conduction signal of the kth frequency point in the $\ell$ th frame and 0, $G(\ell-1, k)$ is the gain corresponding to the kth frequency point in the $(\ell-1)$th frame, $\mathcal{B}(\ell-1, k)$ is the frequency spectrum parameter of the bone conduction frequency spectrum corresponding to the kth frequency point of the $(\ell-1)$th frame, $\widehat{\tau_N}(\ell, k)$ is the frequency spectrum parameter of the bone conduction noise frequency spectrum corresponding to the kth frequency point of the $\ell$ th frame, $\ell$ is the frame index, k is the frequency point index, $0\le k\le N$, N is total number of frequency points, c is a second preset recursive factor which generally ranges from 0.92 to 0.99.

In some embodiments, as can be known from the physical characteristics of the bone conduction signal, its effective signal range is 0 to 1000 Hz. Therefore, when using the bone conduction signal, $0<k\le k_b$, k satisfies $$0<k\cdot\frac{fs}{N}\le 1000,$$

and $f_s$ is the sampling rate.

In some embodiments, the earphone may acquire the bone conduction parameter of the previous frame according to the bone conduction parameter of the current frame, and acquire the bone conduction noise parameter of the previous frame according to the bone conduction noise parameter of the current frame. Then, the earphone calculates the priori signal-to-noise ratio of bone conduction of the previous frame according to Equation 5.

By way of example but not limitation, the posteriori signal-to-noise ratio of bone conduction of the current frame is the posteriori signal-to-noise ratio of the bone conduction signal of the present frame. For example, referring to Equation 6, $|\mathcal{B}(\ell, k)|^2/\widehat{\tau_N^2}(\ell, k)$ is the posteriori signal-to-noise ratio of bone conduction of the current frame. The earphone may calculate the posteriori signal-to-noise ratio of bone conduction of the current frame according to Equation 6.

Please continue to refer to Equation 7. According to Equation 7, the earphone calculates the priori signal-to-noise ratio of bone conduction of the current frame by combining the priori signal-to-noise ratio of bone conduction of the previous frame, the posteriori signal-to-noise ratio of bone conduction of the current frame and the second preset recursive factor.

In some embodiments, the bone conduction gain is the gain of reducing the bone conduction noise. In some embodiments, the earphone may calculate the bone conduction gain according to any suitable gain algorithm, and for example, the gain algorithm comprises the Wiener filtering algorithm or the minimum mean square error algorithm or the like.

In some embodiments, the earphone may obtain the bone conduction noise reduction parameter by multiplying the bone conduction gain by the bone conduction parameter. For example, please refer to Equation 8:

$$\widehat{\mathcal{B}_S}(\ell,k)=G(\ell,k)\cdot\mathcal{B}(\ell,k) \quad \text{Equation 8}$$

wherein G ($\ell$, k) is the bone conduction gain corresponding to the kth frequency point of the $\ell$ th frame, $\mathcal{B}$ ($\ell$, k) is the frequency spectrum parameter of the bone conduction frequency spectrum of the kth frequency point in the $\ell$ th frame, and $\widehat{\mathcal{B}_S}$ ($\ell$, k) is the bone conduction noise reduction parameter of the kth frequency point in the $\ell$ th frame.

S32: calculating the priori signal-to-noise ratio of air-bone integration according to the bone conduction parameter of the current frame and the air conduction noise parameter of the current frame.

For example, the earphone calculates the priori signal-to-noise ratio of air-bone integration according to Equation 9 as follows:

$$\hat{\psi}(\ell,k)=|\widehat{\mathcal{B}_S}(\ell,k)|^2/\widehat{\sigma_a^2}(\ell,k),0<k\leq k_b \quad \text{Equation 9}$$

wherein $\hat{\psi}$($\ell$, k) is the priori signal-to-noise ratio of air-bone integration corresponding to the kth frequency point in the $\ell$ th frame, $\widehat{\sigma_a}$ ($\ell$, k) is the frequency spectrum parameter of the air conduction noise spectrum corresponding to the kth frequency point in the $\ell$ th frame. That is, $\widehat{\sigma_a}$ ($\ell$, k) may be the air conduction noise parameter of the current frame.

S33: performing noise reduction operation according to the priori signal-to-noise ratio of air-bone integration, the air conduction noise reduction parameter and the bone conduction noise reduction parameter.

Because the bone conduction parameter of the current frame is related to the bone conduction sound signal, the air conduction noise parameter of the current frame is related to the environmental noise, and the priori signal-to-noise ratio of air-bone integration is determined by the bone conduction parameter of the current frame and the air conduction noise parameter of the current frame, the priori signal-to-noise ratio of air-bone integration can correlate the bone conduction factor with the environmental noise factor, so that this embodiment can adaptively track and reduce the noise according to the bone conduction sound signal and the environmental noise, and the voice may be conveyed to users more naturally without sense of switching, thereby improving the user experience.

Figure 6:
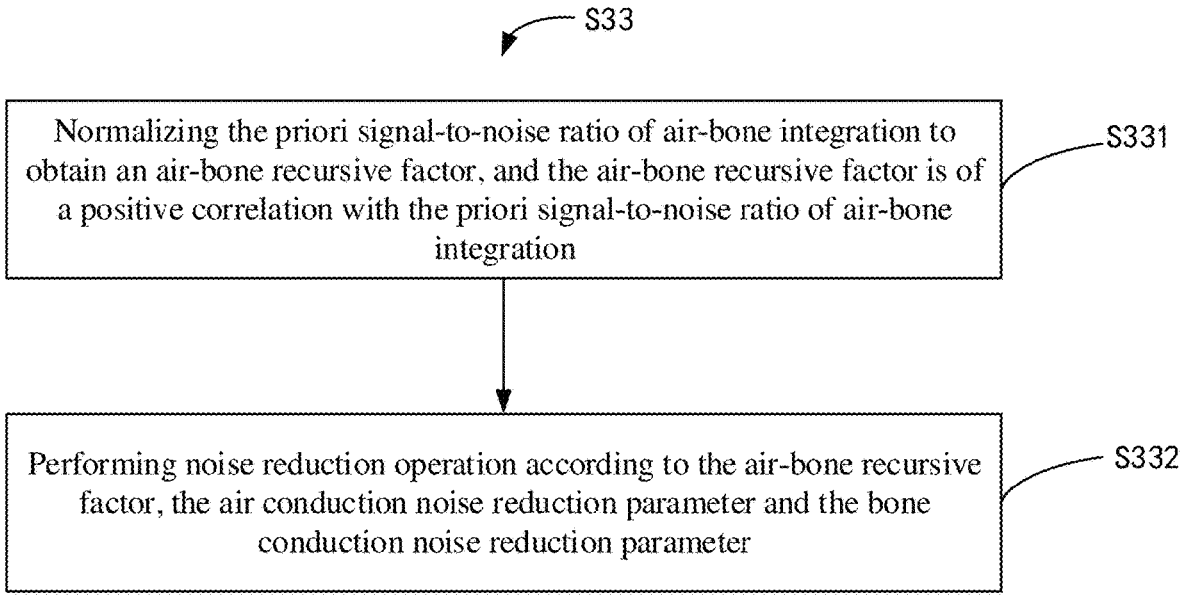
FIG. 6 is a schematic flowchart diagram of S33 shown in FIG. 3.

In some embodiments, referring to FIG. 6, S33 includes:

S331: normalizing the priori signal-to-noise ratio of air-bone integration to obtain an air-bone recursive factor, and the air-bone recursive factor is of a positive correlation with the priori signal-to-noise ratio of air-bone integration;

S332: performing noise reduction operation according to the air-bone recursive factor, the air conduction noise reduction parameter and the bone conduction noise reduction parameter.

In combination with Equation 9, because the numerator of the priori signal-to-noise ratio $\hat{\psi}$($\ell$, k) of air-bone integration is the bone conduction parameter, and the denominator is the environmental noise parameter which is acquired by air conduction microphones, the priori signal-to-noise ratio $\hat{\psi}$($\ell$, k) of air-bone integration is calculated by two microphones with different physical characteristics, there may be different gains between the air conduction microphone and the bone conduction microphone, and this embodiment hopes to use the priori signal-to-noise ratio $\hat{\psi}$($\ell$, k) of air-bone integration as a weighting factor that can measure the proportion of bone conduction sound signals. Therefore, this embodiment may map the priori signal-to-noise ratio $\hat{\psi}$ ($\ell$, k) of air-bone integration in the range from 0 to 1, i.e., to perform normalizing processing.

In some embodiments, because the bone conduction noise reduction parameter $\widehat{\mathcal{B}_S}$ ($\ell$, k) is likely to be larger than the air conduction noise parameter $\widehat{\sigma_a}$ ($\ell$, k) of the current frame, this embodiment selects nonlinear mapping, and this embodiment adopts the hyperbolic tangent function tanh for mapping in the range of 0 to 1.

For example, please refer to Equation 10:

$$\hat{\phi}(\ell,k)=\tanh(\hat{\psi}(\ell,k)) \quad \text{Equation 10}$$

wherein, $\hat{\phi}$($\ell$, k) is the air-bone recursive factor corresponding to the kth frequency point of the $\ell$ th frame.

When the priori signal-to-noise ratio $\hat{\psi}$($\ell$, k) of air-bone integration is larger, it means that the environmental noise signal is smaller relative to the bone conduction signal under the current environmental noise, and the priori signal-to-noise ratio $\hat{\psi}$($\ell$, k) of air-bone integration may be used to measure the influence of environmental noise on the whole speech signal. Therefore, in this embodiment, in order to integrate the priori signal-to-noise ratio $\hat{\psi}$($\ell$, k) of air-bone integration into noise reduction of speech, the mapped air-bone recursive factor $\hat{\phi}$($\ell$, k) follows the following positive correlation relationships: the larger the power parameter $\widehat{\sigma_N^2}$ ($\ell$, k) of the air conduction noise spectrum is, the larger the priori signal-to-noise ratio $\hat{\psi}$($\ell$, k) of air-bone integration will be, and the larger the air-bone recursive factor $\hat{\phi}$($\ell$, k) will be; the smaller the power parameter $\widehat{\sigma_N^2}$ ($\ell$, k) of the air conduction noise spectrum is, the smaller the priori signal-to-noise ratio $\hat{\psi}$($\ell$, k) of air-bone integration will be, and the smaller the air-bone recursive factor $\hat{\phi}$ ($\ell$, k) will be.

In some embodiments, when S332 is executed, the earphone performs noise reduction operation according to Equation 11 and Equation 12:

$$|Y_{out2}(\ell,k)|=\hat{\phi}(\ell,k)\cdot|\widehat{\mathcal{B}_S}(\ell,k)|+(1-\hat{\phi}(\ell,k))\cdot|\widehat{D_S}(\ell,k)|,0\leq k\leq k_b \quad \text{Equation 11}$$

$$Y_{out}(\ell,k)=|Y_{out2}(\ell,k)|*\exp(i*\text{angle}\,\widehat{D_S}(\ell,k)),0\leq k\leq k_b \quad \text{Equation 12}$$

Here, $|Y_{out2}(\ell, k)|$ is the noise reduction amplitude corresponding to the k frequency point of the $\ell$ th frame after bone conduction integration, and $Y_{out}(\ell, k)$ is the frequency spectrum parameter corresponding to the k frequency point in the $\ell$ th frame after bone conduction integration.

As can be known from Equation 12, when both the air conduction frequency point and the bone conduction frequency point are within the effective signal range, the earphone may perform noise reduction operation according to the priori signal-to-noise ratio of air-bone integration, the air conduction noise reduction parameter and the bone conduction noise reduction parameter.

When each of the air conduction frequency points or the bone conduction frequency points isn't in the effective signal range, the earphone performs noise reduction operation according to the air conduction noise reduction parameter. For example, please refer to Equation 13 and Equation 14:

$$|Y_{out2}(\ell,k)|=|\widehat{D_{S_s}}(\ell,k)| \quad \text{Equation 13}$$

$$Y_{out}(\ell,k)=\widehat{D_{S_s}}(\ell,k) \quad \text{Equation 14}$$

Here, $|Y_{out2}(\ell, k)|$ is the noise reduction amplitude corresponding to the kth frequency point of the $\ell$ th frame without bone conduction integration, and $Y_{out}(\ell, k)$ is the frequency spectrum parameter corresponding to the kth frequency point of the $\ell$ th frame without bone conduction integration.

Generally speaking, the earphone can not only perform bone conduction integration within the effective signal range for noise reduction, but also perform noise reduction outside the effective signal range. The noise reduction output results are summarized as follows:

$$|Y_{out2}(\ell,k)| = \begin{cases} \hat{X}(\ell,k)\cdot|\widetilde{B_s}(\ell,k)| + (1-\hat{X}(\ell,k))\cdot|\widetilde{D_s}(\ell,k)|, 0 \le k \le k_b \\ |\widetilde{D_s}(\ell,k)|, \text{ else} \end{cases}$$

$$Y_{out}(\ell,k) = \begin{cases} |Y_{out2}(\ell,k)| * \exp(i * \text{angle}(\widetilde{D_s}(\ell,k))), \varphi(\ell) < \alpha \\ \widetilde{D_s}(\ell,k), \text{ else} \end{cases}$$

Figure 7:
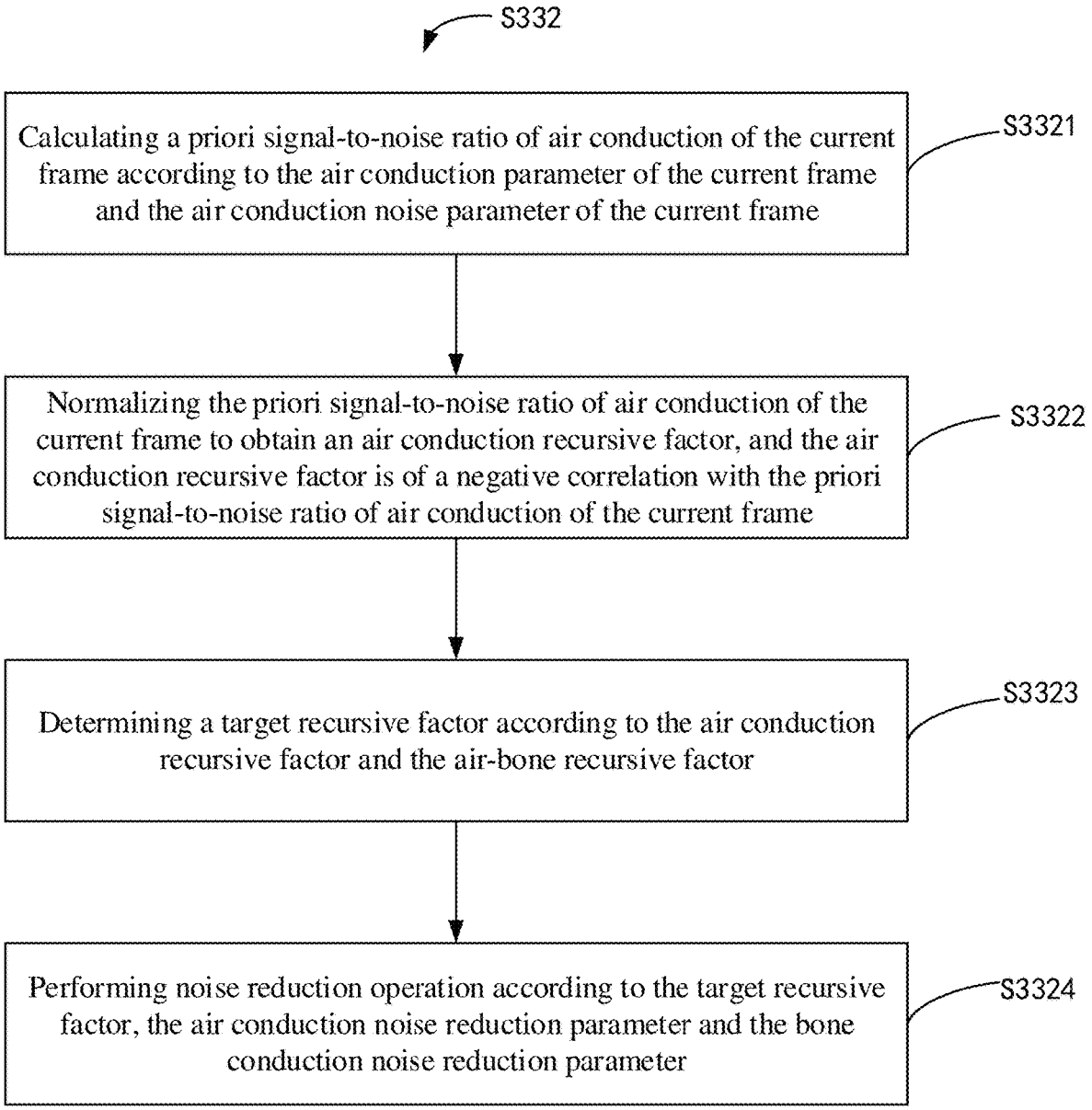
FIG. 7 is a schematic flowchart diagram of S332 shown in FIG. 6.

Usually, when the user uses the air-bone dual-microphone earphone, the user constantly adjusts the earphone so that the earphone cannot cling to bone of the user, which is likely to cause the air-bone recursive factor $\hat{\phi}(\ell, k)$ to be small and unstable. In order to improve the integration reliability between the bone conduction noise reduction parameter and the air conduction noise reduction parameter, this embodiment hopes that the bone conduction noise reduction parameter will occupy as large a proportion as possible in the whole noise reduction parameters during the bone conduction integration process, so as to ensure the intelligibility of the conversation and the noise reduction effect. Therefore, in some embodiments, referring to FIG. 7, S332 includes:

S3321: calculating a priori signal-to-noise ratio of air conduction of the current frame according to the air conduction parameter of the current frame and the air conduction noise parameter of the current frame;

S3322: normalizing the priori signal-to-noise ratio of air conduction of the current frame to obtain an air conduction recursive factor, and the air conduction recursive factor is of a negative correlation with the priori signal-to-noise ratio of air conduction of the current frame;

S3323: determining a target recursive factor according to the air conduction recursive factor and the air-bone recursive factor;

S3324: performing noise reduction operation according to the target recursive factor, the air conduction noise reduction parameter and the bone conduction noise reduction parameter.

In some embodiments, S3321 is executed, and the earphone may calculate the priori signal-to-noise ratio $\widetilde{\xi_a}(\ell, k)$ of air conduction of the current frame according to Equation 1.

In some embodiments, in order to improve the integration reliability between the bone conduction noise reduction parameter and the air conduction noise reduction parameter, and to increase the proportion of the bone conduction noise reduction parameter in the whole noise reduction parameters, this embodiment also uses the priori signal-to-noise ratio of air conduction of the current frame in the bone conduction integration process. Therefore, this embodiment normalizes the priori signal-to-noise ratio of air conduction of the current frame to obtain the air conduction recursive factor, and also makes the air conduction recursive factor be of a negative correlation with the priori signal-to-noise ratio of air conduction of the current frame.

Because the priori signal-to-noise ratio of air conduction of the current frame is determined by the air conduction parameter of the current frame and the air conduction noise parameter of the current frame, and the priori signal-to-noise ratio of air conduction of the current frame is negatively correlated with the air conduction noise parameter of the current frame, the air conduction recursive factor is positively correlated with the air conduction noise parameter of the current frame. That is, the larger the air conduction noise parameter of the current frame is, the larger the air conduction recursive factor will be, and the more favorable it will be to select the target recursive factor which can reflect that "the earphone cannot cling to bone and it is likely to cause the air-bone recursive factor $\hat{\phi}(l, k)$ to be small and unstable" in step S3323. Moreover, the air conduction recursive factor may also be combined with the bone conduction noise reduction parameter and involved in the air-bone integrate process subsequently, so that the bone conduction noise reduction parameter is made to occupy a larger proportion of the whole noise reduction parameters as much as possible, thereby ensuring the intelligibility of the conversation and the noise reduction effect.

In some embodiments, the earphone inverts the priori signal-to-noise ratio of air conduction of the current frame, and then performs nonlinear normalization on the inverted result. In this embodiment, the hyperbolic tangent function tanh is adopted for mapping in the range from 0 to 1, and reference may be made to Equation 15:

$$\hat{\zeta}(l,k)=\tanh(-\widetilde{\xi_a}(l,k))+1 \qquad \text{Equation 15}$$

wherein $\widetilde{\xi_a}(l, k)$ is the priori signal-to-noise ratio of air conduction of the current frame corresponding to the kth frequency point of the lth frame, and $\hat{\zeta}(l, k)$ is the air conduction recursive factor corresponding to the kth frequency point of the lth frame.

In some embodiments, according to Equation 16, the earphone performs noise reduction operation by combining the target recursive factor, the air conduction noise reduction parameter and the bone conduction noise reduction parameter, wherein Equation 16 is as follows:

$$|Y_{out2}(l,k)|=\hat{\chi}(l,k)\cdot|\widetilde{B_S}(l,k)|+1-\hat{\chi}(l,k))\cdot|\widetilde{D_S}(l,k)|, \quad 0\le k\le k_b \qquad \text{Equation 16}$$

wherein $\hat{\chi}(l, k)$ is the target recursive factor corresponding to the kth frequency point of the lth frame.

In some embodiments, in the operation of determining the target recursive factor $\hat{\chi}(l, k)$, the maximum recursive factor among the air conduction recursive factor $\hat{\zeta}(l, k)$ and the air-bone recursive factor $\hat{\phi}(l, k)$ is selected as the target recursive factor, i.e., $$\hat{\chi}(l,k)=\max(\hat{\zeta}(l,k),\hat{\phi}(l,k))$$

By selecting the maximum recursive factor among the air conduction recursive factor $\hat{\zeta}(l, k)$ and the air-bone recursive factor $\hat{\phi}(l, k)$ as the target recursive factor, the problem that "the earphone cannot cling to bone and it is likely to cause the air-bone recursive factor $\hat{\phi}(l, k)$ to be small and unstable" can be further solved, and the noise reduction effect of air bone integration can be improved.

Figure 8:
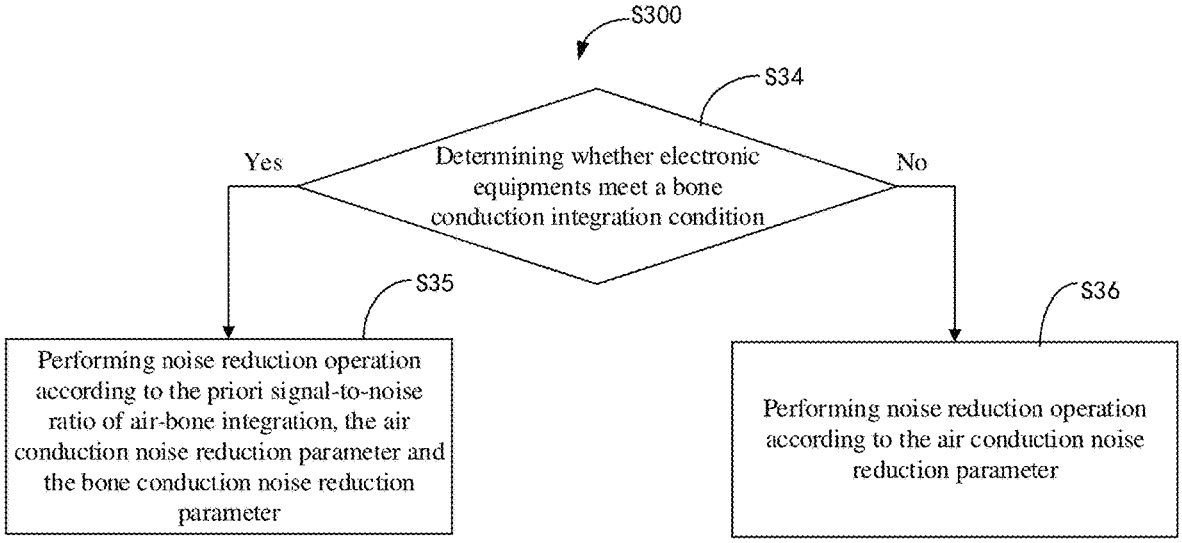
FIG. 8 is a schematic flowchart diagram of a noise reduction method provided according to another embodiment of the present disclosure.

In some embodiments, before S33 is executed, referring to FIG. 8, the method S300 further includes:

S34: determining whether electronic equipments meet a bone conduction integration condition;

S35: if yes, performing noise reduction operation according to the priori signal-to-noise ratio of air-bone integration, the air conduction noise reduction parameter and the bone conduction noise reduction parameter;

S36: if no, performing noise reduction operation according to the air conduction noise reduction parameter.

In some embodiments, the bone conduction integration condition is the condition regarding whether the bone conduction integration operation is performed on the air conduction parameters corresponding to all air conduction frequency points within the effective signal frequency range in the air conduction signal of each frame. If the bone conduction integration condition is met, then the earphone performs the bone conduction integration operation on the air conduction parameters corresponding to all the air conduction frequency points in the effective signal frequency range according to the noise reduction method provided above and in combination with the bone conduction parameter, thereby realizing the purpose of noise reduction. If the bone conduction integration condition is not met, then the earphone performs the noise reduction operation on the air conduction parameters corresponding to all the air conduction frequency points in the effective signal frequency range according to the conventional noise reduction method.

Figure 9:
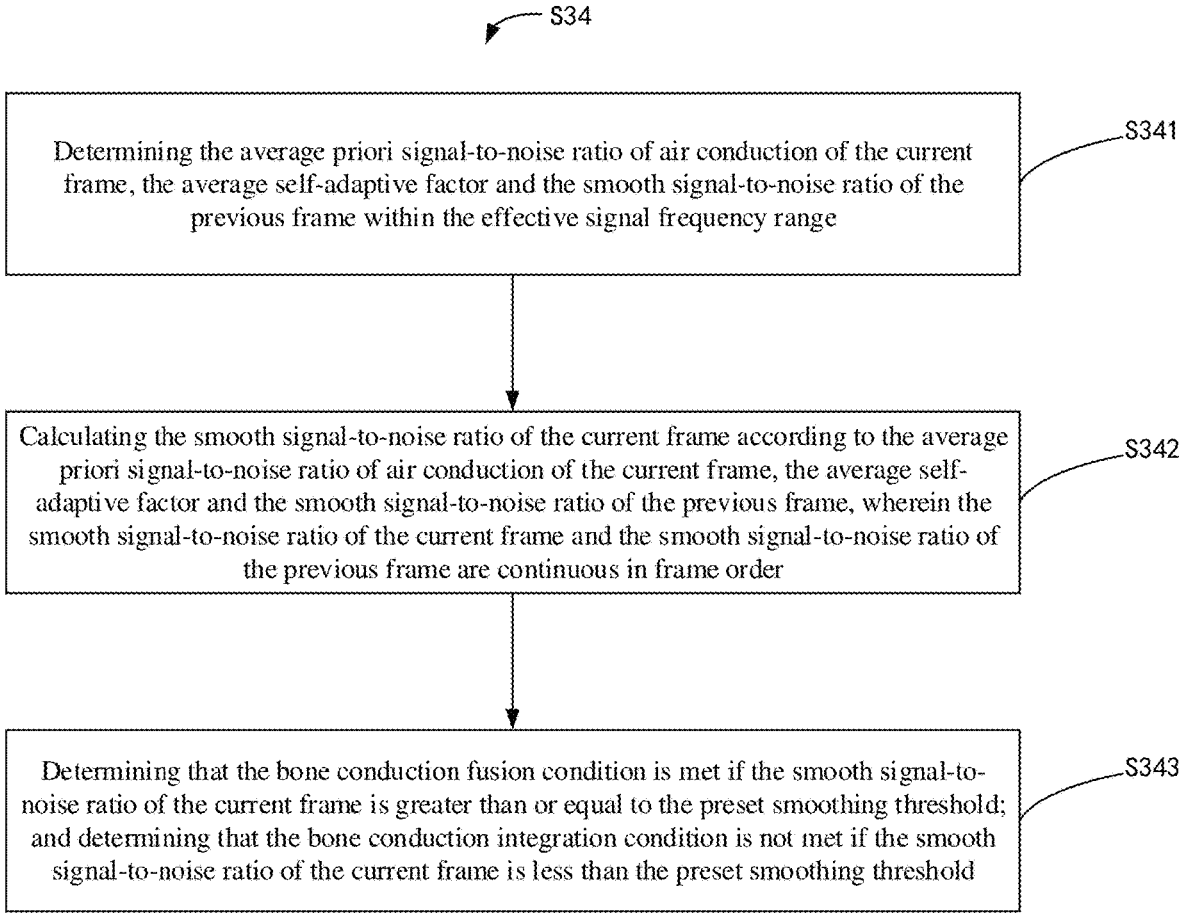
FIG. 9 is a schematic flowchart diagram of S34 shown in FIG. 8.

In some embodiments, referring to FIG. 9, S34 includes:

S341: determining the average priori signal-to-noise ratio of air conduction of the current frame, the average self-adaptive factor and the smooth signal-to-noise ratio of the previous frame within the effective signal frequency range;

S342: calculating the smooth signal-to-noise ratio of the current frame according to the average priori signal-to-noise ratio of air conduction of the current frame, the average self-adaptive factor and the smooth signal-to-noise ratio of the previous frame, wherein the smooth signal-to-noise ratio of the current frame and the smooth signal-to-noise ratio of the previous frame are continuous in frame order;

S343: determining that the bone conduction integration condition is met if the smooth signal-to-noise ratio of the current frame is greater than or equal to the preset smoothing threshold; and determining that the bone conduction integration condition is not met if the smooth signal-to-noise ratio of the current frame is less than the preset smoothing threshold.

In some embodiments, the effective signal frequency range is the frequency range where the air conduction signal integrated to the priori signal-to-noise ratio of air-bone integration is located. In the process of air-bone integration, the air conduction signal is integrated with the bone conduction signal, and the effective signal frequency range corresponding to the bone conduction signal determines the effective signal frequency range corresponding to the air conduction signal. Therefore, in the stage of air-bone integration, as can be known from the physical characteristics of the bone conduction signal, the bone conduction signal may compensate for the air conduction signal in a low frequency band. Generally, the effective signal frequency range is a low frequency band, and the frequency is roughly 0 to 1000 Hz.

Figure 10:
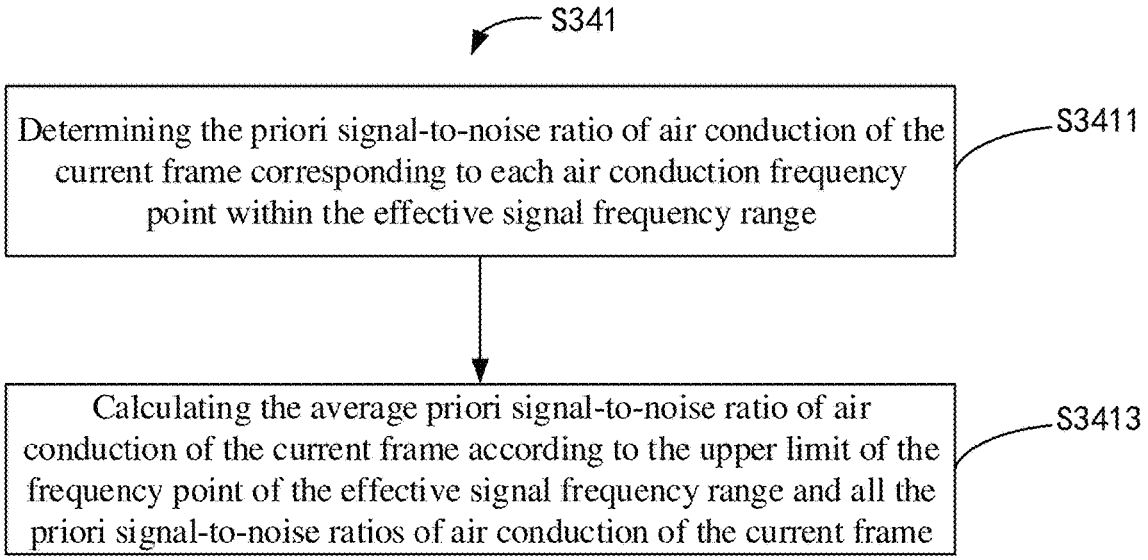
FIG. 10 is a first schematic flowchart diagram of S341 shown in FIG. 9.

In some embodiments, the average priori signal-to-noise ratio of air conduction of the current frame is the average of the priori signal-to-noise ratios of air conduction of the current frame corresponding to all air conduction frequency points within the effective signal frequency range of the present frame. In some embodiments, referring to FIG. 10, the determining the average priori signal-to-noise ratio of air conduction of the current frame within the effective signal frequency range, S341 comprises:

S3411: determining the priori signal-to-noise ratio of air conduction of the current frame corresponding to each air conduction frequency point within the effective signal frequency range;

S3413: calculating the average priori signal-to-noise ratio of air conduction of the current frame according to the upper limit of the frequency point of the effective signal frequency range and all the priori signal-to-noise ratios of air conduction of the current frame.

For example, the earphone calculates the priori signal-to-noise ratio $\hat{\xi}_a(l, k)$ of air conduction of the current frame corresponding to each air conduction frequency point k within the effective signal frequency range according to Equation 1. Then, the earphone calculates the average priori signal-to-noise ratio $\rho(l)$ of air conduction of the current frame according to Equation 17 as follows:

$$\rho(1) = \sum_{k=1}^{k_b} \hat{\xi}_a(1,k)/k_b \qquad \text{Equation 17}$$

wherein, $k_b$ is the upper limit of the frequency point of the air conduction signal within the effective frequency range, and the frequency of each air conduction frequency point k within the effective signal frequency range satisfies the following constraint conditions:

$$0<k\leq k_b$$

$$0 \leq f_k = k \cdot \frac{f_s}{N} \leq 1000$$

wherein $f_k$ is the frequency of the kth air conduction frequency point.

Each priori signal-to-noise ratio $\hat{\xi}_a(l, k)$ of air conduction of the current frame is obtained based on the air conduction parameter and the air conduction noise parameter corresponding to each air conduction frequency point. Therefore, by calculating the average priori signal-to-noise ratio $\rho(l)$ of air conduction of the current frame, the value of overall priori signal-to-noise ratio of air conduction in the air conduction signal of each frame may be expressed when noise reduction is performed by using for example the conventional air conduction noise reduction method, thereby making it convenient to subsequently determine whether the bone conduction integration condition is met.

Figure 11:
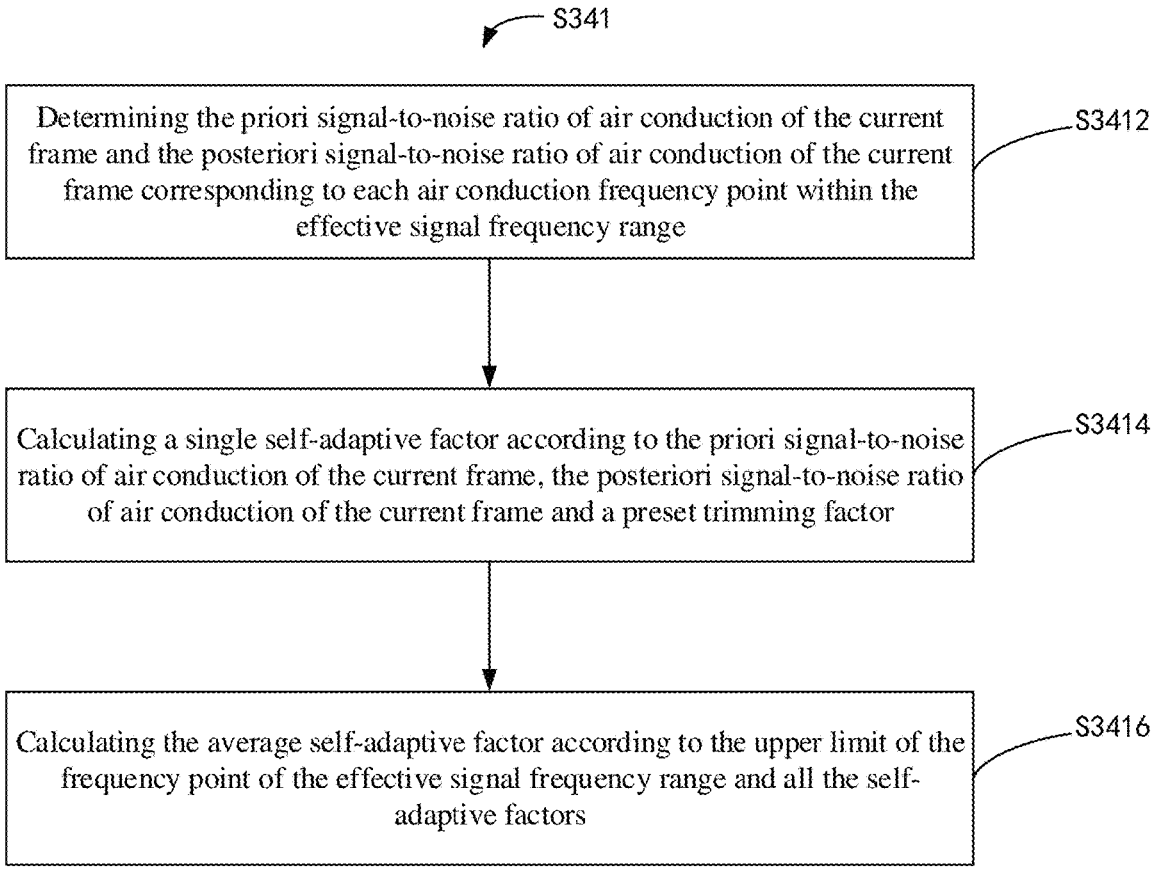
FIG. 11 is a second schematic flowchart diagram of S341 shown in FIG. 9.

In some embodiments, the average self-adaptive factor is the average of the self-adaptive factors corresponding to all air conduction frequency points within the effective signal frequency range of the present frame. In some embodiments, referring to FIG. 11, the determining the average self-adaptive factor within the effective signal frequency range, S341 includes:

S3412: determining the priori signal-to-noise ratio of air conduction of the current frame and the posteriori signal-to-noise ratio of air conduction of the current frame corresponding to each air conduction frequency point within the effective signal frequency range;

S3414: calculating a single self-adaptive factor according to the priori signal-to-noise ratio of air conduction of the current frame, the posteriori signal-to-noise ratio of air conduction of the current frame and a preset trimming factor;

S3416: calculating the average self-adaptive factor according to the upper limit of the frequency point of the effective signal frequency range and all the self-adaptive factors.

For example, the priori signal-to-noise ratio of air conduction of the current frame corresponding to the kth frequency point in the l frame is $\hat{\xi}_a(l, k)$, the posteriori signal-to-noise ratio of air conduction of the current frame corresponding to the kth frequency point in the l frame is $\hat{\gamma}_a(l, k)=|Y(l, k)|^2/\hat{\sigma}_N^2(l, k)$, as described in Equation 3, $|Y(l, k)|^2$ is the power parameter of the air conduction power spectrum corresponding to the kth frequency point in the lth frame and $\hat{\sigma}_N^2(l, k)$ is the power parameter of the air conduction noise spectrum corresponding to the kth frequency point in lth frame.

The earphone calculates a single self-adaptive factor according to Equation 18 as follows:

$$\beta(l,k) = \frac{\hat{\xi}_a(l,k)}{\hat{\gamma}_a(l,k) + \varepsilon} \quad \text{Equation 18}$$

wherein ε is the preset trimming factor, and β(l, k) is the single self-adaptive factor corresponding to the kth frequency point of the lth frame.

Then, the earphone calculates the average self-adaptive factor according to Equation 19 as follows:

$$\delta(l) = \sum_{k=0}^{k_b} \beta(l,k)/k_b \quad \text{Equation 19}$$

wherein δ(l) is the average self-adaptive factor.

In some embodiments, the smooth signal-to-noise ratio of the current frame is a factor after recursively smoothing the average priori signal-to-noise ratio of air conduction of the current frame. In some embodiments, the earphone calculates the smooth signal-to-noise ratio of the current frame according to Equation 20 as follows:

$$\varphi(l)=\rho(l)\times(1-\delta(l))+\varphi(l-1)\times\delta(l) \quad \text{Equation 20}$$

wherein φ(l) is the smooth signal-to-noise ratio of the current frame, φ(l−1) is the smooth signal-to-noise ratio of the previous frame, and φ(l) and φ(l−1) are continuous in the frame order. As can be known from Equation 20, the smooth signal-to-noise ratio φ(l) of the current frame is related to the smooth signal-to-noise ratio φ(l−1) of the previous frame and the average self-adaptive factor δ(l), and the single self-adaptive factor is respectively related to the priori signal-to-noise ratio $\hat{\xi}_a(l, k)$ of air conduction of the current frame and the posteriori signal-to-noise ratio $\hat{\gamma}_a(l, k)$ of air conduction of the current frame. By using Equation 20, a smoother and more reliable smooth signal-to-noise ratio φ(l) of the current frame can be obtained.

If the smooth signal-to-noise ratio φ(l) of the current frame is greater than or equal to the preset smoothing threshold α, and it is determined that the bone conduction integration condition is not met, then it means that the priori signal-to-noise ratios of air conduction of the current frame corresponding to all the air conduction frequency points with the effective signal frequency range in each frame are still greater than or equal to the preset smoothing threshold α after smoothing processing, and it also means that most of priori signal-to-noise ratios of air conduction of the current frame are greater than or equal to the preset smoothing threshold α. Effective noise reduction can be achieved simply by adopting the conventional air conduction noise reduction method, and the natural hearing feeling of air conduction speech may be reliably retained without performing bone conduction integration noise reduction.

If the smooth signal-to-noise ratio φ(l) of the current frame is less than the preset smoothing threshold α, and it is determined that the bone conduction integration condition is met, then it means that the priori signal-to-noise ratios of air conduction of the current frame corresponding to all the air conduction frequency points with the effective signal frequency range in each frame are still less than the preset smoothing threshold α after smoothing processing, and it also means that most of priori signal-to-noise ratios of air conduction of the current frame are less than the preset smoothing threshold α. In this case, if the bone conduction integration noise reduction operation is not performed, the noise will drown the normal speech in the low frequency band. Therefore, the earphone needs to perform noise reduction operation according to the priori signal-to-noise ratio of air-bone integration, the air conduction noise reduction parameter and the bone conduction noise reduction parameter.

Generally speaking, when the implementation of the noise reduction method provided in this embodiment is triggered by the bone conduction integration condition, on the one hand, it is helpful to improve the noise reduction efficiency, and on the other hand, it is necessary to reduce noise reliably while ensuring the noise reduction efficiency. For example, if the bone conduction integration condition is met, then the noise reduction method provided in this embodiment is adopted; and if the bone conduction integration condition is not met, then the conventional air conduction noise reduction method is adopted.

It should be noted that, in each of the above embodiments, the above steps are not necessarily executed in a certain order. According to the description of the embodiments of the present disclosure, those of ordinary skill in the art may understand that in different embodiments, the above steps may be executed in different orders. That is, these steps may be executed in parallel or the steps may be exchanged for execution, and so on.

As the bone conduction signal involved in the noise reduction method provided in this embodiment is the bone conduction signal within the effective frequency range, in order to express the noise reduction effect more effectively, the speech spectrum of 200 Hz to 800 Hz may be selected in each figure for explanation.

Figure 12:
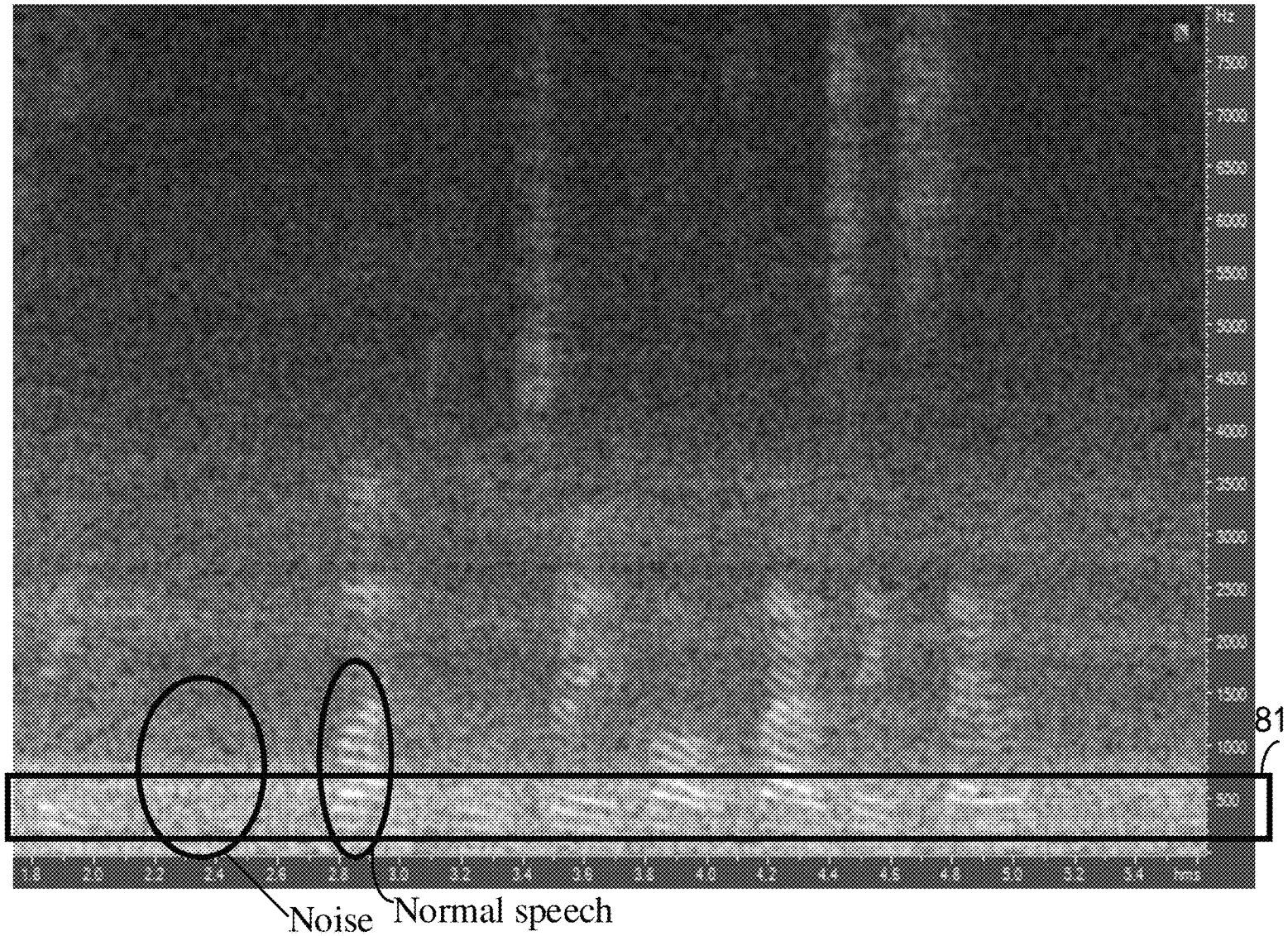
FIG. 12 is a schematic view of a noisy speech spectrum provided according to an embodiment of the present disclosure, wherein noise reduction operation has not been performed on the noisy speech spectrum.

In FIG. 12, the speech spectrum area 81 comprises noise and normal speech. As can be known from FIG. 12, between 200 Hz and 800 Hz, the noise is scattered in the normal speech at various time points.

Figure 13:
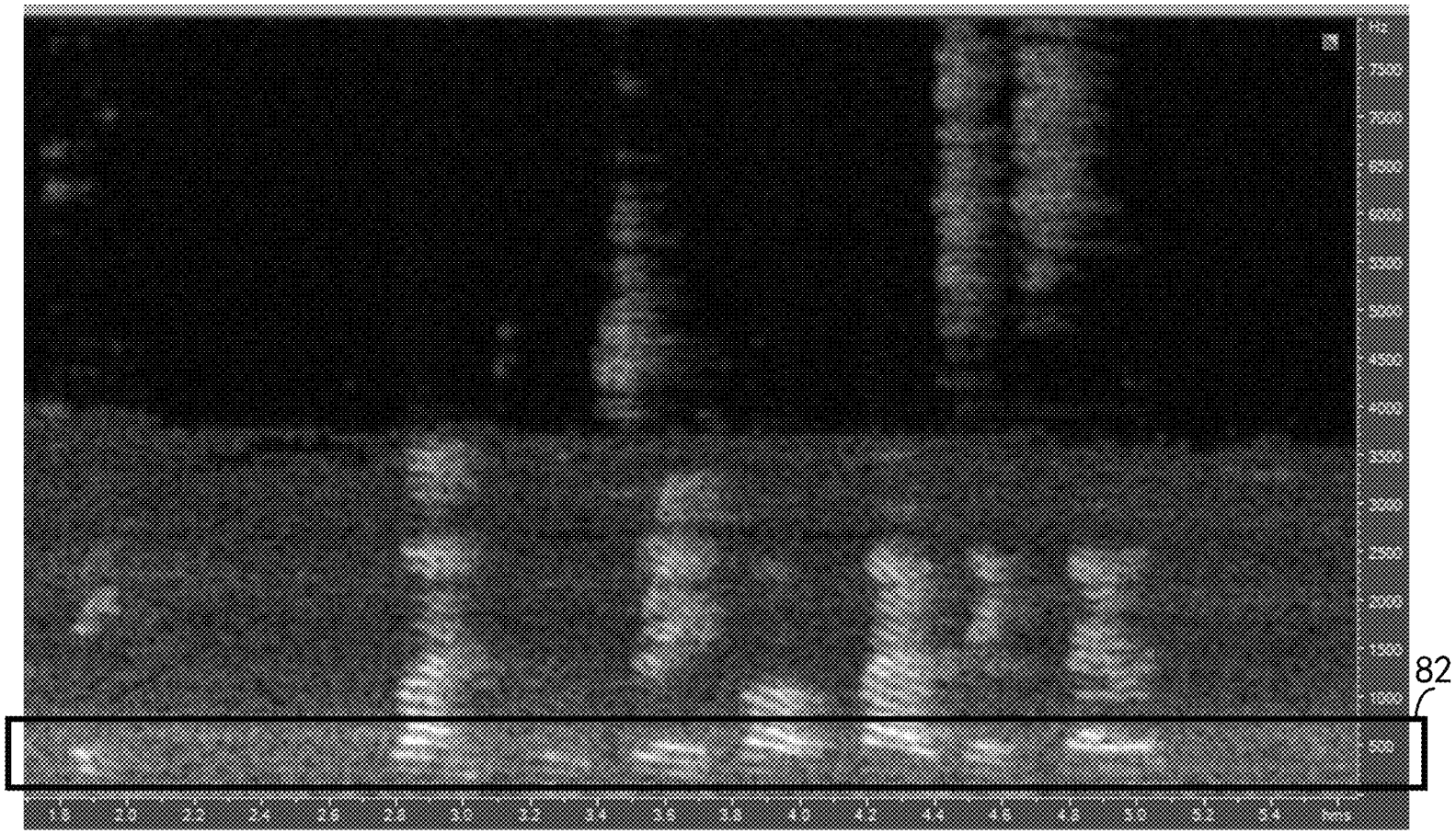
FIG. 13 is a schematic view of the noisy speech spectrum shown in FIG. 12 after noise reduction by using the conventional noise reduction method based on air conduction single channel.

In FIG. 13, the speech spectrum area 82 comprises noise and normal speech. As can be known from FIG. 13, as compared to the speech spectrum area 81 of FIG. 12, between 200 Hz and 800 Hz, some noises remain although some noises are filtered. In addition, the normal speech between 200 Hz and 800 Hz is also filtered, especially in the partial speech spectrum close to 200 Hz, and voice distortion is more likely to occur when this phenomenon is more obvious.

Figure 14:
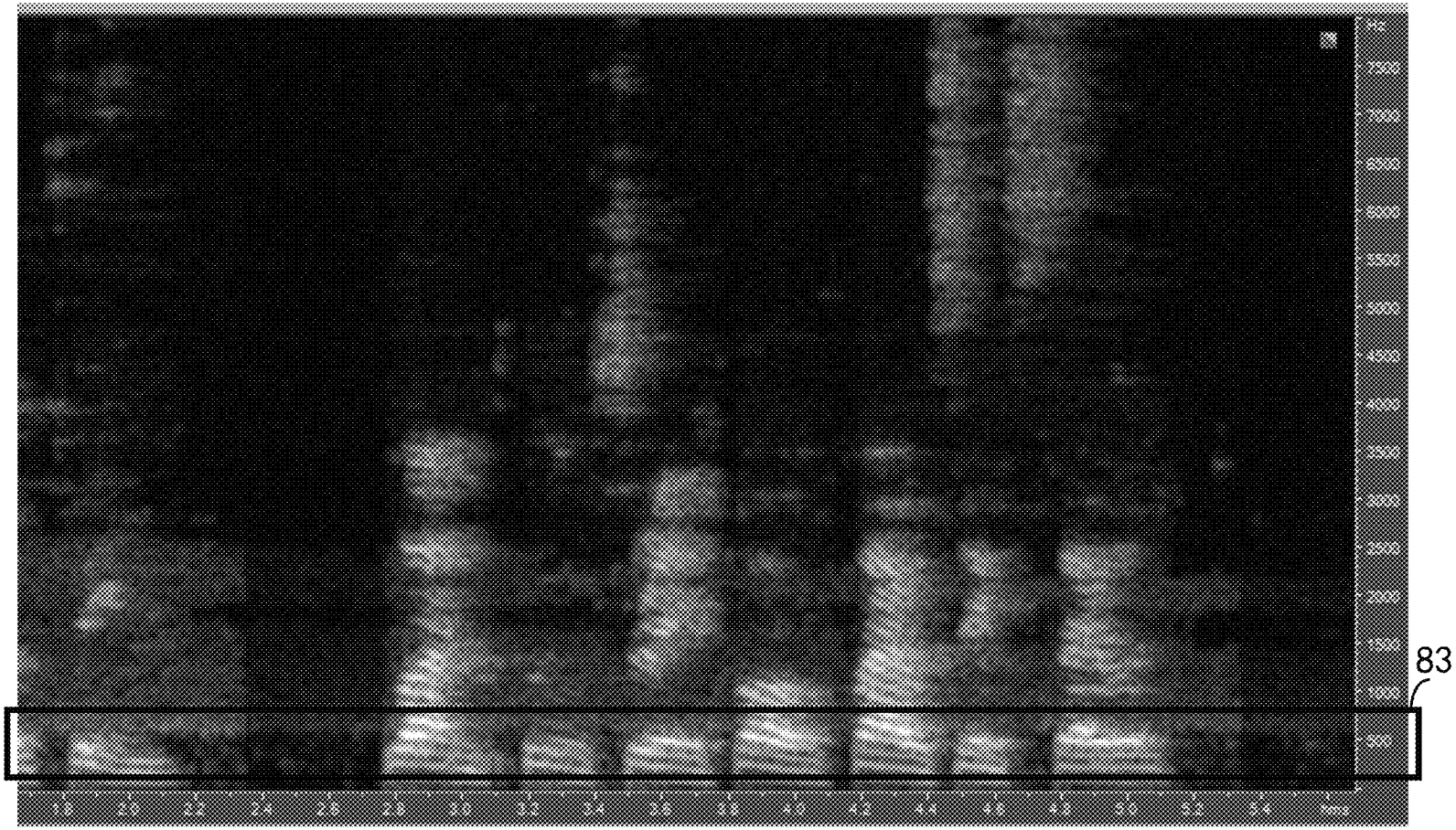
FIG. 14 is a schematic view of the noisy speech spectrum shown in FIG. 12 after noise reduction by using the noise reduction method provided in this embodiment.

In FIG. 14, the speech spectrum area 83 comprises noise and normal speech. As can be known from FIG. 14, as compared to the speech spectrum area 82 in FIG. 13, most of the noise is filtered between 200 Hz and 800 Hz. In addition, the normal speech between 200 Hz and 800 Hz is almost preserved, especially in the partial speech spectrum near 200 Hz, and the probability of voice distortion is reduced when the preservation phenomenon is more obvious.

Figure 15:
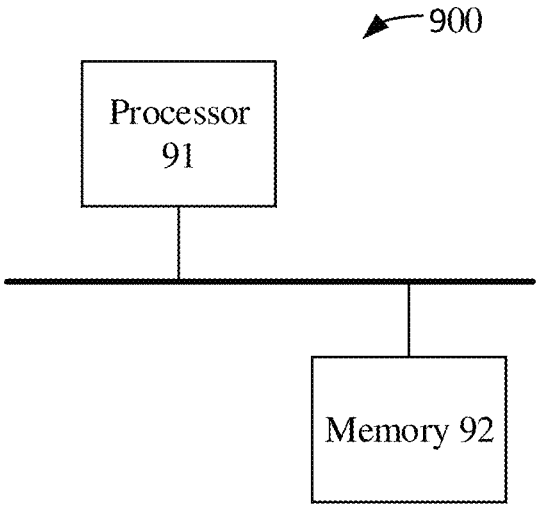
FIG. 15 is a schematic view of a circuit structure of an electronic equipment provided according to an embodiment of the present disclosure.

Please refer to FIG. 15, which is a schematic view of a circuit structure of an electronic equipment provided according to an embodiment of the present disclosure, wherein the electronic equipment may be electronic products such as a chip. As shown in FIG. 15, an electronic equipment 900 comprises one or more processors 91 and a memory 92. In FIG. 15, one processor 91 is taken as an example.

The processor 91 and the memory 92 may be connected by a bus or other means, and the connection achieved by a bus is taken as an example in FIG. 15.

As a nonvolatile computer readable storage medium, the memory 92 may be used to store nonvolatile software programs, nonvolatile computer executable programs and modules, such as program instructions/modules corresponding to the noise reduction method in the embodiment of the present disclosure. The processor 91 performs various function applications of the noise reduction device and data processing, i.e., achieves the noise reduction method provided according to the above embodiments of the method and functions of various modules or units of the above embodiments of the device by running nonvolatile software programs, instructions and modules stored in the memory 92.

The memory 92 may comprise a high-speed random access memory, and may also comprise a nonvolatile memory, such as at least one magnetic disk memory device, flash memory device, or other nonvolatile solid-state memory device. In some embodiments, the memory 92 optionally comprises memories remotely located relative to the processor 91, and these remote memories may be connected to the processor 91 through a network. Examples of the above network comprise but are not limited to the Internet, Intranet, local area networks, mobile communication networks and combinations thereof.

The program instructions/modules are stored in the memory 92, and when executed by the one or more processors 91, execute the noise reduction method in any of the above embodiments of the method.

An embodiment of the present disclosure further provides a nonvolatile computer storage medium, in which computer executable instructions are stored. The computer executable instructions, when executed by one or more processors, e.g., a processor 91 in FIG. 15, cause the one or more processors to execute the noise reduction method in any of the above embodiments of the method.

An embodiment of the present disclosure further provides a computer program product, which comprises a computer program stored on a nonvolatile computer readable storage medium, and the computer program comprises program instructions. The program instructions, when executed by an electronic equipment, cause the electronic equipment to execute any of the noise reduction methods.

The embodiments of the above-described devices or equipments are only schematic. The unit modules described as separate components may or may not be physically separated, and components displayed as module units may or may not be physical units, that is, they may be located in one place or distributed over multiple network module units. Some or all of the modules may be selected according to actual needs to achieve the purpose of this embodiment.

From the description of the above embodiments, those skilled in the art may clearly understand that each embodiment may be realized by means of software plus a general hardware platform, and of course, it may also be realized by hardware. Based on such understanding, the essence of the above technical solution or the part that contributes to related technologies may be embodied in the form of software products. The computer software products may be stored in computer-readable storage media, such as a ROM/RAM, a magnetic disk, an optical disk or the like, and they comprise several instructions to make a computer equipment (which may be a personal computer, a server, or a network equipment, etc.) execute the method described in various embodiments or some parts of embodiments.

Finally, it shall be noted that, the above embodiments are only used to illustrate the technical solution of the present disclosure, but not to limit the present disclosure. Under the concept of the present disclosure, technical features in the above embodiments or different embodiments may also be combined, the steps may be realized in any order, and many other variations in different aspects of the present disclosure as described above are possible, and these variations are not provided in details for conciseness. Although the present disclosure has been described in detail with reference to the foregoing embodiments, those of ordinary skill in the art shall appreciate that, the technical solutions described in the foregoing embodiments may still be modified or some of the technical features may be equivalently replaced. These modifications or substitutions do not make the essence of the corresponding technical solutions deviate from the scope of the technical solutions of various embodiment of the present disclosure.

What is claimed is:

1. A method for reducing noise, comprising:

obtaining an air conduction noise reduction parameter and a bone conduction noise reduction parameter, the air conduction noise reduction parameter being obtained by integrating an air conduction parameter of the current frame and an air conduction noise parameter of the current frame, and the bone conduction noise reduction parameter being obtained by integrating a bone conduction parameter of the current frame and a bone conduction noise parameter of the current frame;

calculating a priori signal-to-noise ratio of air-bone integration according to the bone conduction parameter of the current frame and the air conduction noise parameter of the current frame; and performing noise reduction operation according to the priori signal-to-noise ratio of air-bone integration, the air conduction noise reduction parameter and the bone conduction noise reduction parameter.

2. The method of claim 1, wherein the performing noise reduction operation according to the priori signal-to-noise ratio of air-bone integration, the air conduction noise reduction parameter and the bone conduction noise reduction parameter comprises:

normalizing the priori signal-to-noise ratio of air-bone integration to obtain an air-bone recursive factor, and the air-bone recursive factor being of a positive correlation with the priori signal-to-noise ratio of air-bone integration; and performing noise reduction operation according to the air-bone recursive factor, the air conduction noise reduction parameter and the bone conduction noise reduction parameter.

3. The method of claim 2, wherein the performing noise reduction operation according to the air-bone recursive factor, the air conduction noise reduction parameter and the bone conduction noise reduction parameter comprises:

calculating a priori signal-to-noise ratio of air conduction of the current frame according to the air conduction parameter of the current frame and the air conduction noise parameter of the current frame;

normalizing the priori signal-to-noise ratio of air conduction of the current frame to obtain an air conduction recursive factor, and the air conduction recursive factor being of a negative correlation with the priori signal-to-noise ratio of air conduction of the current frame;

determining a target recursive factor according to the air conduction recursive factor and the air-bone recursive factor; and performing noise reduction operation according to the target recursive factor, the air conduction noise reduction parameter and the bone conduction noise reduction parameter.

4. The method of claim 3, wherein the determining a target recursive factor according to the air conduction recursive factor and the air-bone recursive factor comprises:

selecting the largest recursive factor between the air conduction recursive factor and the air-bone recursive factor as the target recursive factor.

5. The method of claim 2, wherein the normalizing the priori signal-to-noise ratio of air-bone integration to obtain an air-bone recursive factor comprises:

converting the priori signal-to-noise ratio of air-bone integration into an air-bone recursive factor according to hyperbolic tangent function tanh.

6. The method of claim 2, wherein the air conduction parameter of the current frame is of a negative correlation with the air-bone recursive factor.

7. The method of claim 1, wherein the obtaining the air conduction noise reduction parameter comprises:

calculating the priori signal-to-noise ratio of air conduction of the previous frame and a posteriori signal-to-noise ratio of air conduction of the current frame respectively according to the air conduction parameter of the current frame and the air conduction noise parameter of the current frame;

calculating the priori signal-to-noise ratio of air conduction of the current frame according to the priori signal-to-noise ratio of air conduction of the previous frame, the posteriori signal-to-noise ratio of air conduction of the current frame and a first preset recursive factor;

calculating an air conduction gain according to the priori signal-to-noise ratio of air conduction of the current frame; and generating an air conduction noise reduction parameter according to the air conduction gain and the air conduction parameter of the current frame.

8. The method of claim 1, wherein the obtaining the bone conduction noise reduction parameter comprises:

calculating the priori signal-to-noise ratio of bone conduction of the previous frame and the posteriori signal-to-noise ratio of bone conduction of the current frame respectively according to the bone conduction parameter of the current frame and the bone conduction noise parameter of the current frame;

calculating the priori signal-to-noise ratio of bone conduction of the current frame according to the priori signal-to-noise ratio of bone conduction of the previous frame, the posteriori signal-to-noise ratio of bone conduction of the current frame and a second preset recursive factor;

calculating a bone conduction gain according to the priori signal-to-noise ratio of bone conduction of the current frame; and generating a bone conduction noise reduction parameter according to the bone conduction gain of the current frame and the bone conduction parameter of the current frame.

9. The method of claim 1, wherein before the operation of performing noise reduction operation according to the priori signal-to-noise ratio of air-bone integration, the air conduction noise reduction parameter and the bone conduction noise reduction parameter, the method further comprises:

determining whether electronic equipments meet a bone conduction integration condition;

if yes, performing noise reduction operation according to the priori signal-to-noise ratio of air-bone integration, the air conduction noise reduction parameter and the bone conduction noise reduction parameter;

if no, performing noise reduction operation according to the air conduction noise reduction parameter.

10. The method of claim 9, wherein the determining whether the bone conduction integration condition is met comprises:

determining the average priori signal-to-noise ratio of air conduction of the current frame, the average self-adaptive factor and the smooth signal-to-noise ratio of the previous frame within the effective signal frequency range;

calculating the smooth signal-to-noise ratio of the current frame according to the average priori signal-to-noise ratio of air conduction of the current frame, the average self-adaptive factor and the smooth signal-to-noise ratio of the previous frame, wherein the smooth signal-to-noise ratio of the current frame and the smooth signal-to-noise ratio of the previous frame are continuous in frame order; and determining that the electronic equipments fail to meet the bone conduction integration condition if the smooth signal-to-noise ratio of the current frame is greater than or equal to the preset smoothing threshold; and determining that the electronic equipments meet the bone conduction integration condition if the smooth signal-to-noise ratio of the current frame is less than the preset smoothing threshold.

11. The method of claim 10, wherein the determining the average priori signal-to-noise ratio of air conduction of the current frame within the effective signal frequency range comprises:

determining the priori signal-to-noise ratio of air conduction of the current frame corresponding to each air conduction frequency point within the effective signal frequency range; and calculating the average priori signal-to-noise ratio of air conduction of the current frame according to the upper limit of the frequency point of the effective signal frequency range and all the priori signal-to-noise ratios of air conduction of the current frame.

12. The method of claim 10, wherein the determining the average self-adaptive factor within the effective signal frequency range comprises:

determining the priori signal-to-noise ratio of air conduction of the current frame and the posteriori signal-to-noise ratio of air conduction of the current frame corresponding to each air conduction frequency point within the effective signal frequency range;

calculating a single self-adaptive factor according to the priori signal-to-noise ratio of air conduction of the current frame, the posteriori signal-to-noise ratio of air conduction of the current frame and a preset trimming factor; and calculating the average self-adaptive factor according to the upper limit of the frequency point of the effective signal frequency range and all the self-adaptive factors.

13. The method of claim 10, wherein the effective signal frequency is low frequency band.

14. The method of claim 13, wherein the low frequency band is in a range from 0 Hz to 1000 Hz.

15. The method of claim 11, wherein the calculating the average priori signal-to-noise ratio of air conduction of the current frame according to the upper limit of the frequency point of the effective signal frequency range and all the priori signal-to-noise ratios of air conduction of the current frame comprises:

calculating a first sum of the priori signal-to-noise ratio of air conduction of the current frame of all the air conduction frequency point within the effective signal frequency range; and calculating the average priori signal-to-noise ratio of air conduction of the current frame according to the first sum and the upper limit of the frequency point.

16. The method of claim 12, wherein the calculating the average self-adaptive factor according to the upper limit of the frequency point of the effective signal frequency range and all the self-adaptive factors comprises:

calculating a second sum of the self-adaptive factors of all the air conduction frequency point within the effective signal frequency range; and calculating the average self-adaptive factor according to the second sum and the upper limit of the frequency point.

17. A non-transitory storage medium, storing computer executable instructions for causing an electronic equipment to:

obtaining an air conduction noise reduction parameter and a bone conduction noise reduction parameter, the air conduction noise reduction parameter being obtained by integrating an air conduction parameter of the current frame and an air conduction noise parameter of the current frame, and the bone conduction noise reduction parameter being obtained by integrating a bone conduction parameter of the current frame and a bone conduction noise parameter of the current frame;

calculating a priori signal-to-noise ratio of air-bone integration according to the bone conduction parameter of the current frame and the air conduction noise parameter of the current frame; and performing noise reduction operation according to the priori signal-to-noise ratio of air-bone integration, the air conduction noise reduction parameter and the bone conduction noise reduction parameter.

18. A chip, comprising:

at least one processor; and a memory communicatively connected with the at least one processor; wherein the memory stores instructions capable of being executable by the at least one processor to enable the at least one processor to execute the method of claim 1.

* * * * *